US005557948A

United States Patent [19]

Shima et al.

[11] Patent Number: 5,557,948

[45] Date of Patent: Sep. 24, 1996

[54] YARN GUIDING METHOD AND APPARATUS FOR FLAT KNITTING MACHINE

[75] Inventors: Masahiro Shima; Minoru Sonomura, both of Wakayama, Japan

[73] Assignee: Shima Seiki Mfg. Ltd., Wakayama-ken, Japan

[21] Appl. No.: 425,915

[22] Filed: Apr. 20, 1995

[30] Foreign Application Priority Data

Apr. 28, 1994 [JP] Japan ..... 6-113892
Apr. 6, 1995 [JP] Japan ..... 7-107911

[51] Int. Cl.[6] ..... D04B 7/04

[52] U.S. Cl. ..... 66/64; 66/60 R; 66/106

[58] Field of Search ..... 66/60 R, 60 H, 66/61, 64, 126 R

[56] References Cited

U.S. PATENT DOCUMENTS 3,362,195 1/1968 Gosis ..... 66/64 X
5,355,699 10/1994 Imagaki et al. ..... 66/60 R X
5,369,965 12/1994 Shima et al. ..... 66/64
5,408,849 4/1995 Schimko et al. ..... 66/64 X

FOREIGN PATENT DOCUMENTS 1168550 12/1958 France ..... 66/64
47-33745 8/1972 Japan ..... 66/60 R
62-223348 10/1987 Japan .
1465466 3/1989 U.S.S.R. ..... 66/60 R

*Primary Examiner*—John J. Calvert
*Attorney, Agent, or Firm*—Loeb & Loeb LLP

[57] ABSTRACT

A yarn guiding apparatus for a flat knitting machine in which a pair of opposed needle beds defines a knock over edge area and a center line therebetween. A yarn holding member is arranged between a needle and a sinker mounted on a needle bed. The yarn holding member is moveable relative to the knock over edge area and has an operating face for pushing down a yarn fed from a yarn feeder to the knock over edge area. The operating face is configured for contacting the yarn and for pushing the yarn down toward a needle when the yarn holding member is advanced toward the knock over edge area. The yarn holding member is advanceable to a position in which a portion of the yarn holding member extends beyond the center line defined by the opposing needle beds.

11 Claims, 17 Drawing Sheets

② Af: POSITION TO GUIDE YARN TO REAR FACE SIDE OF FRONT NEEDLE
Ab: POSITION TO GUIDE YARN TO HOOK OF BACK NEEDLE
④ Bf: POSITION TO GUIDE YARN TO HOOK OF FRONT NEEDLE
Bb: POSITION TO GUIDE YARN TO HOOK OF BACK NEEDLE

YARN GUIDING METHOD AND APPARATUS FOR FLAT KNITTING MACHINE

BACKGROUND OF THE INVENTION

1. Field of the Invention

This invention relates to a yarn guiding method and apparatus for a flat knitting machine for holding a yarn supplied to a needle to a predetermined position on the front face or the rear face of the needle.

2. Prior Art

In a flat knitting machine, a sinker is used as means for holding down a loop formed by operation of a needle. A sinker is located between each adjacent ones of a plurality of needles arranged in a row. The sinker operates in response to advancing and retracting movements of associated needles such that, when the needles are at their raised positions, the sinker is at its rearwardly rocked position, and in this condition, a yarn is supplied to the needles and caught by the hooks of the needles by subsequent retracting movements of the needles themselves. Then, after loops are formed by the needles, the sinker is rocked forwardly until it covers over a knock over edge area. Such a sequence of operations as described above is repeated for the needles to knit a fabric.

In the apparatus described above, when a yarn is caught by a needle to which the yarn is supplied first, the yarn continuously supplied from the yarn feeder can be held down by adjacent sinkers as the sinkers are rocked forwardly, and accordingly, the yarn can be knit floating above a large number of needles.

With the apparatus described above, however, if the yarn cannot be caught by a needle to which the yarn is supplied first, the yarn cannot be held down by the succeeding sinkers and consequently cannot be caught by any needle (Japanese Patent Laid-Open Application No. Showa 62-223348). Further, the yarn cannot be guided to the rear faces of the needles.

SUMMARY OF THE INVENTION

In view of the foregoing, it is an object of the present invention to allow a novel knitting method wherein a yarn supplied from a yarn feeder can be held to the hook side of a front face of a needle which is to perform a knitting operation or such yarn supplied from the yarn feeder and another yarn knitted already and extending between needles can be held accurately to predetermined object positions of a rear face of a needle which is to perform a knitting operation so that, even if successive miss needles are present on a knit texture, a next needle can catch the yarn with certainty and a yarn can be forced to a rear face of a needle to allow knitting of an inlay fabric or an intarsia fabric which involves a sudden increase in pattern width and besides a yarn can be twined around one or a plurality of needles at an advanced position to form loops having twined yarns.

In the present invention, a yarn pushing down operating face of a yarn holding down member is advanced between a sinker and a needle toward a yarn which extends from a yarn feeder to the needle or a yarn knitted already and extending between the needle and another needle to guide the yarn into a hook or a rear face of the needle.

The yarn holding down member is contacted, during knitting of a knit fabric, with the yarn extending from the yarn feeder to the needle rearwardly in an advancing direction of the yarn feeder and pushes down the yarn into an area of a locus of back and forth movement of the hook of the needle.

The yarn holding down member is contacted, during knitting of a knit fabric, with the yarn extending from the yarn feeder to the needle or the yarn knitted already and extending between the needle and another needle forwardly in an advancing direction of the yarn feeder before the needle is raised until a head portion thereof advances farther than the yarn, and then guides, when the needle is raised farther than the yarn, the yarn to a rear face of the needle.

The yarn holding down member having a yarn pushing down operating face at an end portion thereof is provided for advancing and retracting movements between each adjacent ones a plurality of needles and sinkers arranged in a row, and operation means is provided for the yarn holding down members.

Each of the yarn holding down members is provided at a position at which the yarn pushing down operating face is contacted, when the yarn holding down member is advanced, with a yarn supplied from a yarn feeder to an adjacent needle rearwardly in an advancing direction of the yarn feeder and then can push down the yarn into an area of a locus of back and forth movement of the hook of the needle, and is positioned so that, when the yarn holding down member is advanced, an end thereof goes farther than a center line between knock over edges.

The yarn operating face at the end of each of the yarn holding down members is formed such that an upper portion thereof extends farther than a lower portion thereof toward a center line between knock over edges so as to push down a yarn and an upper end edge of the yarn operating face at the end thereof is at a position higher than a yarn passing area.

The yarn holding down members are provided at upper positions of one or both of a pair of needle beds disposed with heads thereof opposed to each other and are provided by a number equal to or smaller than the number of needles.

The operation means of the yarn holding down members includes a control butt provided on each of the yarn holding down members and a yarn holding down member advancing and retracting cam provided on a cam box provided for back and forth movement on a needle bed and having a cam groove thereon, and the control butts of the yarn holding down members are engaged with the cam groove. The operation means includes a device for controlling an advancing ann retracting movement of the yarn holding down member which adjusts the height of a cam lobe of the yarn holding down member advancing and retracting cam.

The operation means further includes selection means and can select an arbitrary one or ones of the yarn holding down members and is provided in the proximity of a knock over edge above each or one of a pair of inclined faces of a raising cam.

An actuator having a projecting element for projecting each of the yarn holding down members is provided at a yarn holding down member selection position, and selection means is provided for engaging, when the projecting element is projected by operation of the actuator, the control butt with the cam groove of the yarn holding down member advancing and retracting cam.

In the present invention, to hold a supplied yarn to the rear face of a needle, that is, to a position at which the yarn will not be caught by the hook of the needle and to hold such supplied yarn to another position at which the yarn is caught by the hook of the needle, that is, the front face of the needle, are performed with certainty. The holding operation of the supplied yarn to the rear face of the needle is performed in the following manner. One of the yarn holding down members which is positioned in the proximity of the needle is selected by the selection means, and the operating face at the end of the yarn holding down member is moved toward the supplied yarn by the yarn holding down member advancing and retracting cam prior to a rising movement of the needle, whereupon the yarn is pushed down at the knock over edge area by the downward inclination of the operating face of the yarn holding down member. Since the needle rises to the position, the hook of the needle passes above the yarn, and consequently, the yarn is positioned to the rear face of the needle.

In order to hold the supplied yarn to the hook side of the needle, when the needle having been raised by the raising cam starts its downward movement, the yarn holding down member is selected in a similar manner as described above and is advanced to the knock over edge by the cam. By such advancement, the operating face at the front end of the yarn holding down member is engaged with and pushes down the yarn. In this instance, since the end of the needle is at the yarn supplying position, the yarn is contacted with the latch of the needle within the locus of pivotal motion of the latch or with the hook within a range within which the hook is closed up with a slider, and is arrested by the hook when the needle is lowered subsequently.

BRIEF DESCRIPTION OF THE DRAWINGS

FIG. 1 shows an apparatus of the present invention, and FIG. 1A is a vertical sectional view taken in the proximity of top portions of needles beds in a condition in which a yarn holding down member is selected and is a sectional view taken along line B—B of FIG. 1B while

DETAILED DESCRIPTION OF PREFERRED EMBODIMENT

An embodiment of the present invention will be described below with reference to the drawings.

Figure 1A:
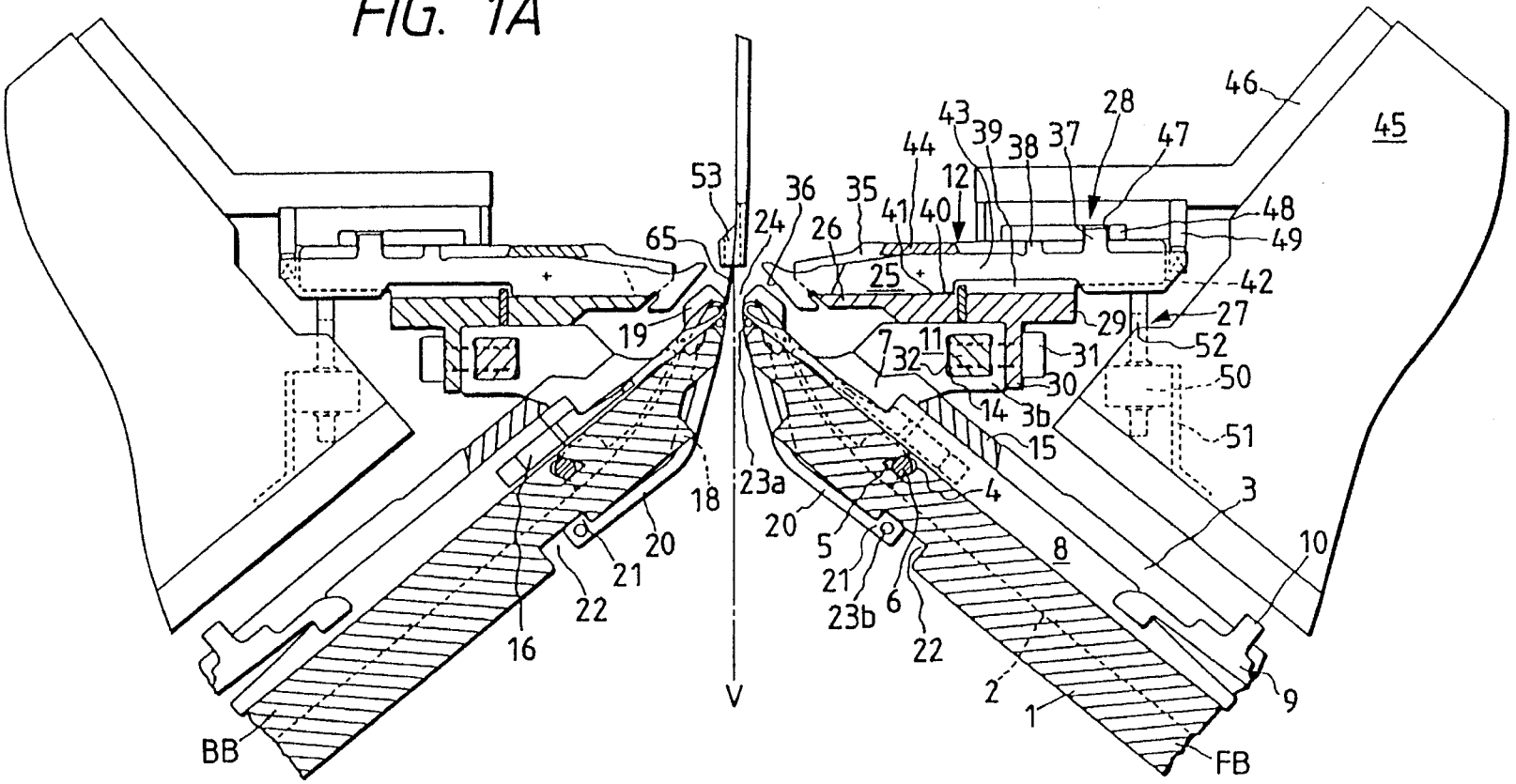
Figure 1B:
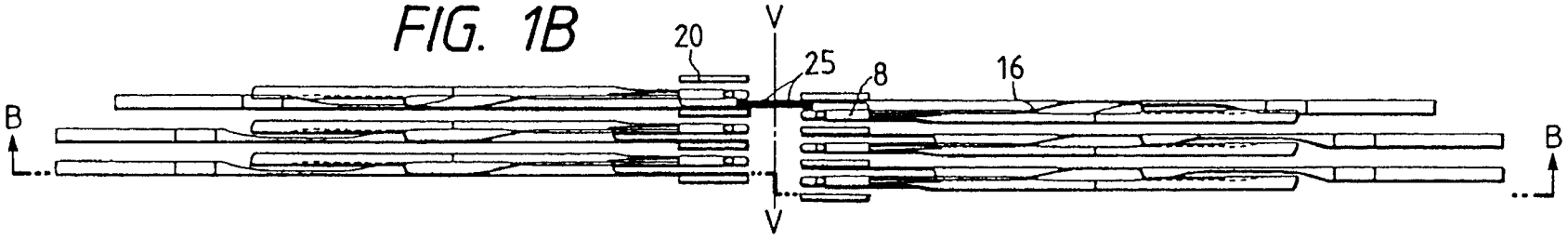
FIG. 1B is a partial plan view only of needles, sinkers and yarn holding down members.

FIG. 1 shows a vertical sectional view of needle beds 1 and an enlarged plan view partly cut away. In the flat knitting machine of the present invention, two needle beds 1 are provided including a front bed FB and a back bed BB disposed on the front and the back with respect to a vertical imaginary center line V between knock over edges with head portions thereof opposed to each other in a mountain-like configuration. Since the needle beds 1 of the front bed FB and the back bed BB have a same structure, the structure of the needle bed 1 of the front bed FB will be described below.

The needle bed 1 has a plurality of parallel needle plate grooves 2 formed thereon by machining, and a needle plate 3 is inserted in each of the needle plate grooves 2. An oblique recessed portion 4 is formed on a lower face of each of the needle plate 3, and another oblique recessed portion 5 is formed on an upper face of the needle bed 1. The needle plates 3 and the needle bed 1 are arranged such that the recessed portions 4 and the recessed portion 5 are aligned with each other and a wire 6 is threaded in the thus aligned recessed portions 4 and 5 while, though not shown, tail portions of the needle plates 3 and the needle bed 1 are caulked to each other to secure the needle plates 3 and the needle bed 1 to each other. Thus, a needle groove 7 is formed between each adjacent ones of the needle plates 3, 3, and a needle 8, a needle jack 9 for operating the needle 8, a selector, a select jack and so forth not shown are inserted for sliding movement in each of the needle grooves 7.

Figure 3:
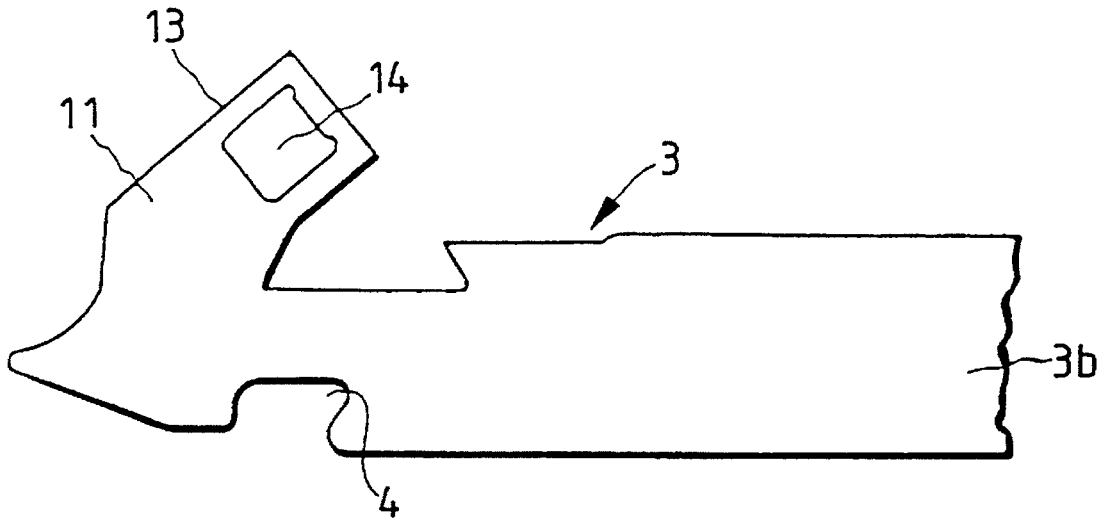
FIG. 3 is a side elevational view of a needle plate having a projecting portion.
Figure 4:
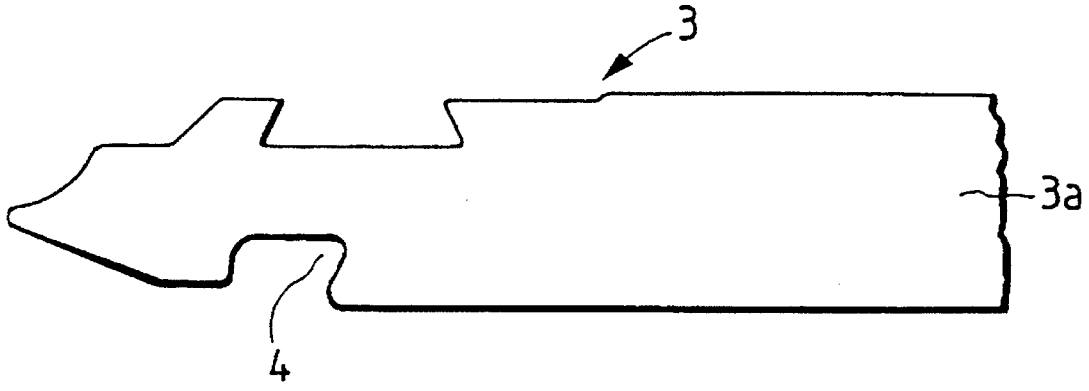
FIG. 4 is a side elevational view of another needle plate having no projecting portion.

The needle plates 3 are divided into two groups including first needle plates 3*a* which have such a profile as shown in FIG. 4 wherein they have a height sufficient to allow needle jack butts 10 provided on the needle jacks 9 of the needles 8 inserted in the needle grooves 7 between the needle plates 3, 3 to project farther than the needle plates 3 and an upper edge of each of them extends substantially linearly, and second needle plates 3*b* which have such a profile as shown in FIG. 3 wherein they have an equal height and a same profile as those of the first needle plates 3*a* except that an upper edge of a head portion extends upwardly to form a projecting portion 11 which has an upper edge serving as a supporting face 13 for a yarn guiding apparatus 12 which will be hereinafter described and has a hole 14 (although the hole 14 has a substantially square shape in the example shown in FIG. 3, it may have a circular shape or any other shape) formed therein. The first needle plates 3*a* and 3*b* may be inserted alternately in the needle plate grooves 2 or the second needle plates may be provided by a number smaller than the number of first needle plates.

The needles 8 are prevented from coming off the needle grooves 7 by a band 15 fitted in the needle plates 3 in a direction perpendicular to the needle grooves 7. The needles 8 shown in FIG. 1 are each in the form of a transfer needle having a transfer element 16 provided thereon as a transfer member. However, a latch needle or a compound needle may alternatively be employed for the needles 8. Each of the needle plates 3 has a blade accommodating groove formed therein by machining so that a blade 16 may not contact with the needle plate 3. In each needle plate 3 having a smaller thickness, the groove extends from one side to the other side of the needle plate 3*b*.

A plurality of parallel sinker plate fitting grooves 18 are formed on a lower face at an end of the needle bed 1 having an acute angle. A sinker plate 20 in the form of a plate member having an obtuse L-shaped side elevation is fitted in each of the sinker plate fitting grooves 18 such that a square portion 19 at an end thereof is partially arrested at the needle bed 1 while a hook 21 at a base end portion thereof is engaged with a recessed portion-22 provided on the lower face of the needle bed 1 to secure the sinker plate 20 to the needle bed 1. Reference characters 23*a* and 23*b* denote each a wire threaded through the sinker plate 20, and the wire 23*a* acts as a loop arresting wire for arresting loops of a knitted fabric depending from the knock over edge and relates to a knock over timing.

Each of the sinker plate 20 need not be fixed as described above, but may naturally be constructed otherwise as such a sinker plate of the movable type that, while it is in the form of a plate member, it can be advanced to and retracted from a knock over edge 24 by forward and backward movements or by pivotal motion at an end portion of the needle bed 1.

Figure 2:
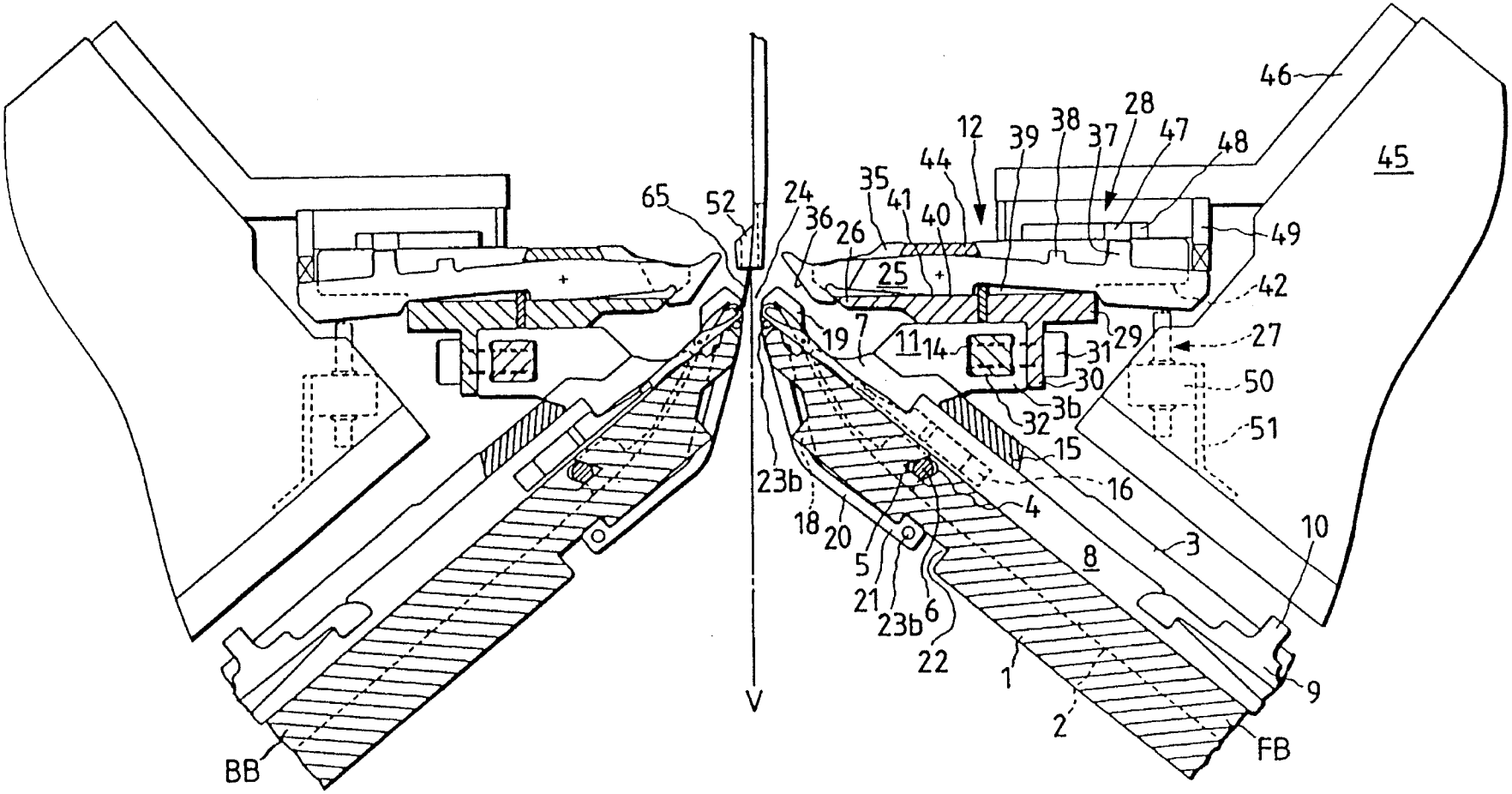
FIG. 2 shows the apparatus of the present invention and is a vertical sectional view taken in the proximity of the top portions of the needle beds in a condition where a yarn holding down member is not selected.

The yarn guiding apparatus 12 will be described below. The yarn guiding apparatus 12 is provided above each of the front bed FB and the back bed BB provided with head portions thereof disposed in an opposing relationship to each other so as to present a mountain-like configuration as shown in FIGS. 1 and 2, and the two apparatus 12, 12 can hold and guide a yarn so that the yarn can be used to knit a knit fabric with certainty in any knitting condition. However, when a yarn is used for knitting while it is held under a high tension or when the knitting speed is considerably low, only one of the two yarn guiding apparatus 12 may be used. Each of the yarn guiding apparatus 12 includes a plurality of yarn holding down members 25, a yarn holding down member supporting bed 26 for supporting the yarn holding down members 25 thereon, selection means 27 for selecting the yarn holding down members 25, and operation means 28 for operating the yarn holding down members 25. The yarn holding down member supporting bed 26 has a substantially T-shaped side elevation and is secured to the projecting portions 11 of the needle plates 3*b* such that a horizontal portion 29 at an upper portion thereof is placed on the supporting faces 13 of the projecting portions 11 of the needle plates 3*b* and screws 31 of a vertical arm 30 extending downwardly are screwed to a bar 32 threaded in the holes 14 of the projecting portions 11. The yarn holding down members 25 are inserted for sliding movement in a plurality of grooves 35 formed at the horizontal portion of the upper portion of the yarn holding down member supporting bed 26. The grooves 35 are provided by an equal number to the number and at an equal pitch to the pitch of the needle grooves 7. However, the number of the grooves 35 may be set smaller than the number of the needle grooves 7 with the distance between the grooves 35 set to an integral number of times the distance between the needle grooves 7. Each of the yarn holding down members 25 is, in the example shown in the drawings, in the form of an elongated plate member and is shaped such that an operating face 36 provided at a front end thereof is formed as an operating face whose upper side is projected forwardly toward the imaginary center plane V between the knock over edges 24 and whose lower side is retracted from the imaginary center plane V so that, when a yarn holding down member 25 is advanced while a yarn is contacted with the inclined face 36, the inclined face 36 guides the yarn into the hook of an associated needle 8 or to the rear face of the associated needle 8. When the inclined face 36 of the yarn holding down members 25 guides a yarn into the hook of the needle 8, where the needle 8 is a latch needle, the yarn should be positioned within the locus of pivotal motion of the latch so that, when the needle is lowered, the latch is turned back to take the yarn into the hook. Where the needle 8 is a compound needle, the yarn should be positioned within the hook of the needle which is closed by a slider. A control butt 37 and a stopper butt 38 are provided on an upper edge of the yarn holding down member 25 while a recess 39 is provided on a lower edge of each of the yarn holding down members 25. Further, an inclined face 40 is provided at a position forwardly of the recess 39 such that a tail portion 42 of the yarn holding down member 25 may be rocked upwardly and downwardly around a fulcrum provided by a top portion 41 of the inclined face 40.

Each of the yarn holding down members 25 is bent a little at an intermediate portion thereof in such a manner as to present an L-shape in plan so that it may not move inadvertently when it is fitted in a groove 35. Reference numeral 43 denotes a stopper, and 44 denotes a band for preventing the yarn holding down members 25 from coming off the grooves 35 and guiding the yarn holding down members 25. When the yarn holding down members 25 are in a horizontal position, the control butts 37 thereof project from the grooves 35.

While the yarn holding down members 25 are inserted for sliding movement in the grooves 35 of the yarn holding down member supporting bed 26 as described above, the number of the grooves 35 may be smaller than the number of the needle grooves 7 as described hereinabove. Generally in a flat knitting machine, floating between needles over a distance of approximately 1 inch is possible, and if only floating of a yarn is considered in the present invention, then where the knitting machine is, for example, a 7 gauge machine, it is sufficient to dispose one yarn holding down member for each seven needles. Further, if it is intended to cause a yarn to be caught by or pass behind a needle or needles at a particular position, a yarn holding down member may be disposed at a location corresponding to the needle or needles. When needles with which the present invention is to be reduced to practice vary among different courses of knitting, the yarn guide members should be disposed in the entire area of the needle bed from the beginning. Also in this instance, the yarn guide members need not be provided for every needle.

Figure 5:
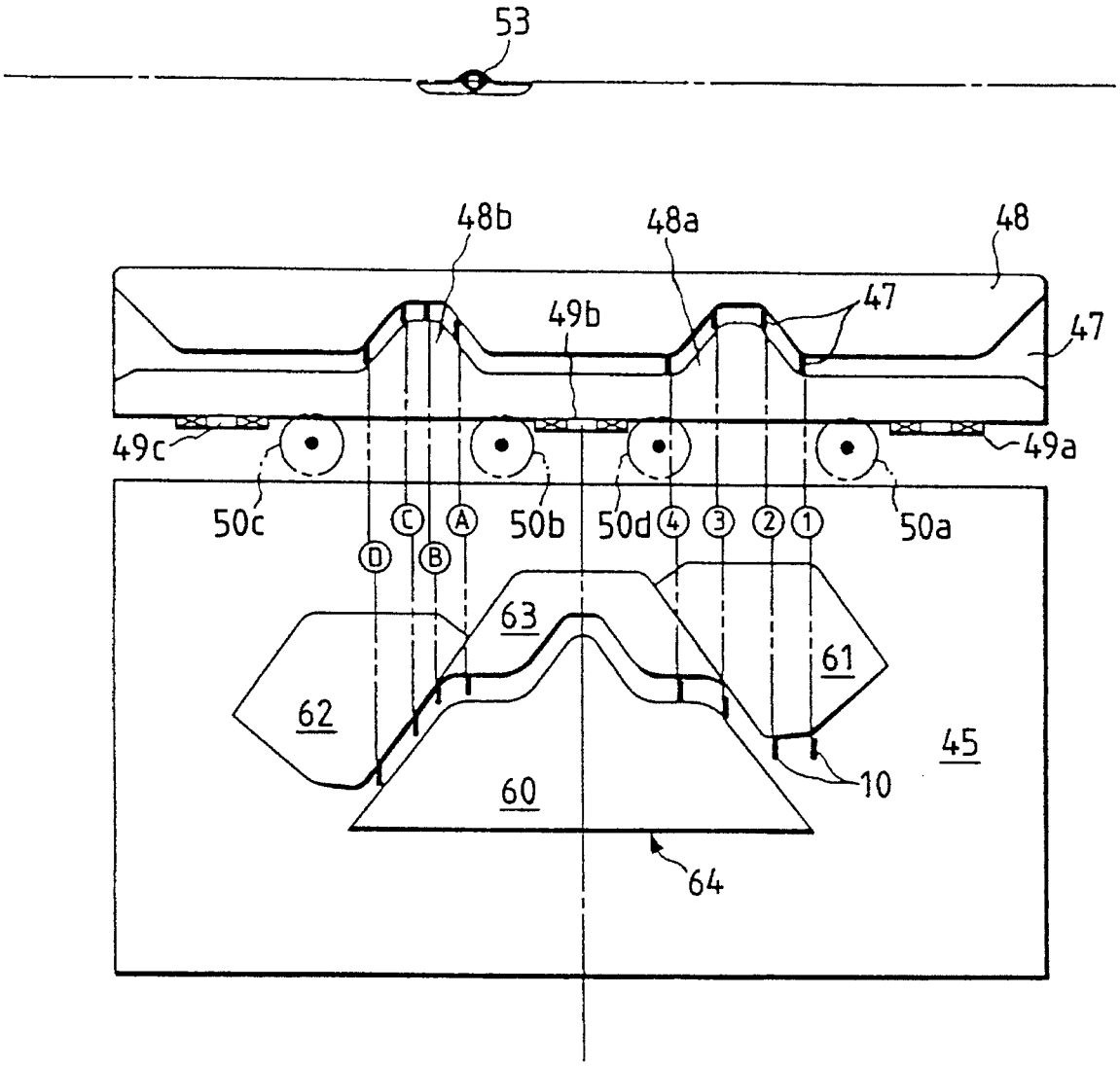
FIG. 5 is an arrangement diagram showing the positional relationship among needle operating cams, yarn holding down member advancing and retracting cams, returning cams and actuators.
Figure 6A:
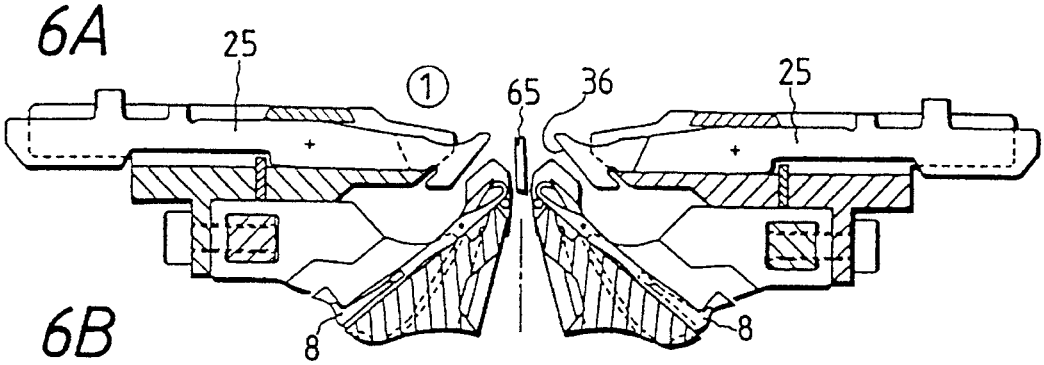
FIGS. 6A, 6B, 6C and 6D are views of operating conditions of a needle and a yarn holding down member when a knitting yarn is guided to the rear face side of the needle.
Figure 6B:
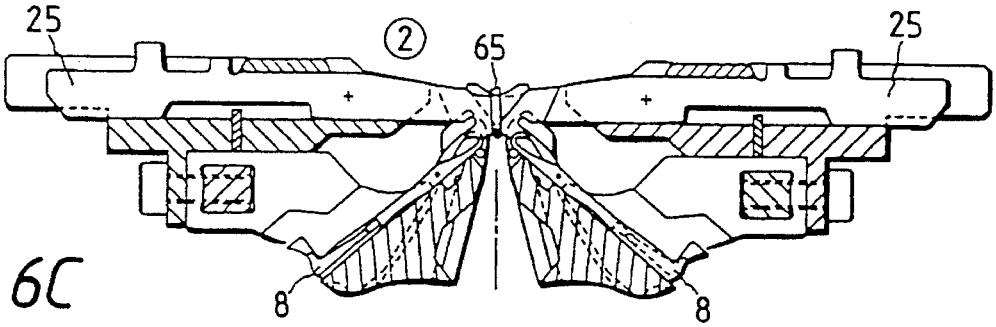
Figure 6C:
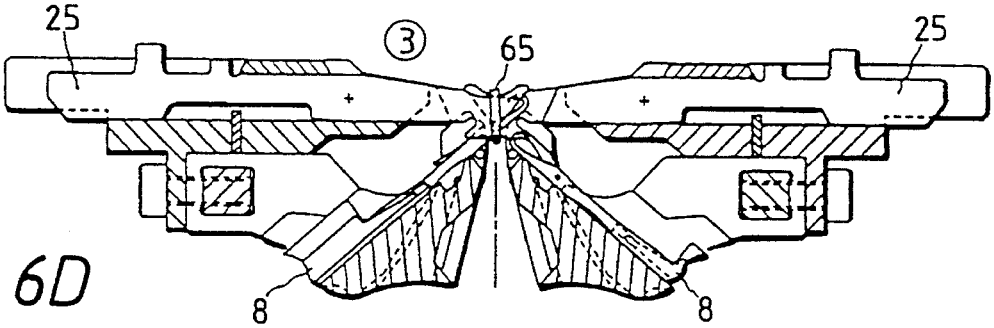
Figure 6D:
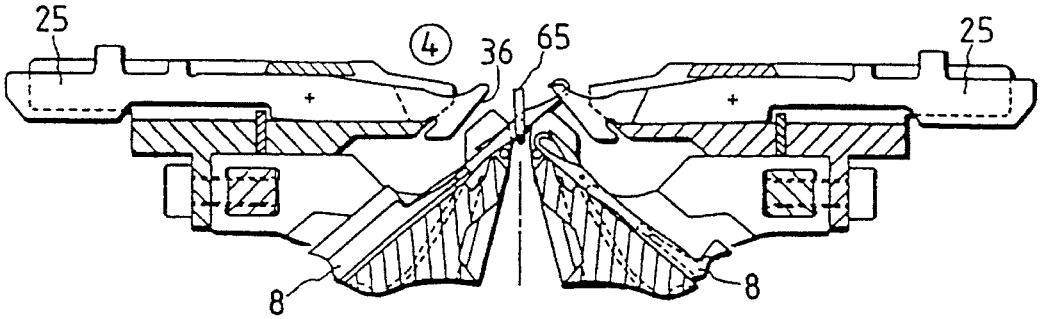
Figure 7A:
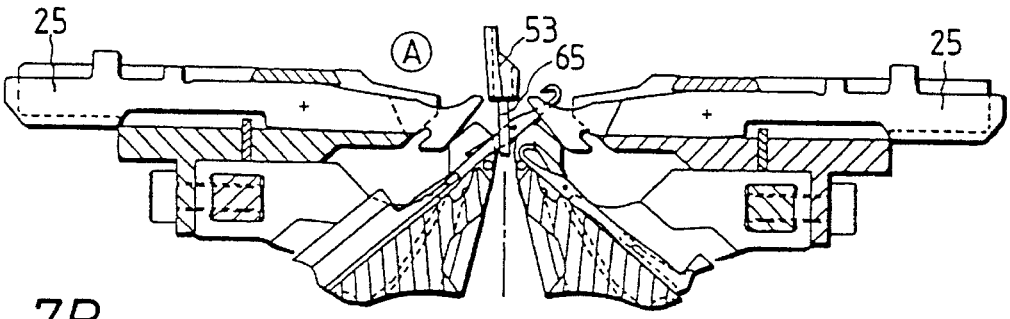
FIGS. 7A, 7B, 7C and 7D are views of operating conditions of a needle and a yarn holding down member when a knitting yarn is guided to the hook side of the needle.
Figure 7B:
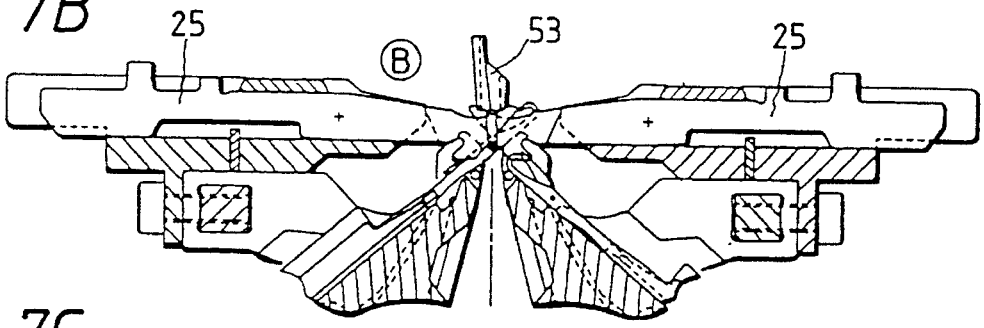
Figure 7C:
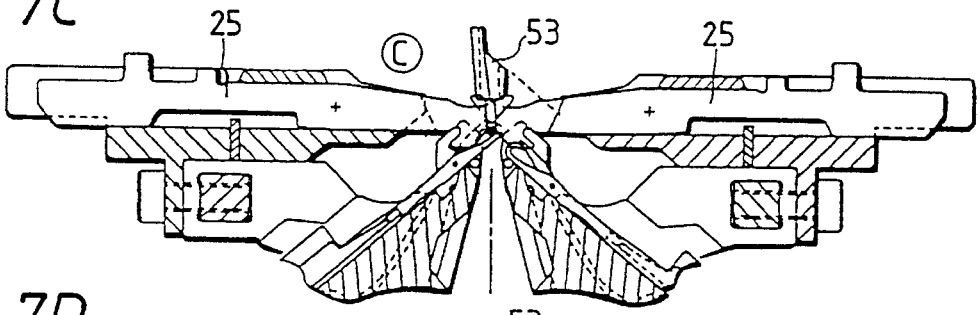
Figure 7D:
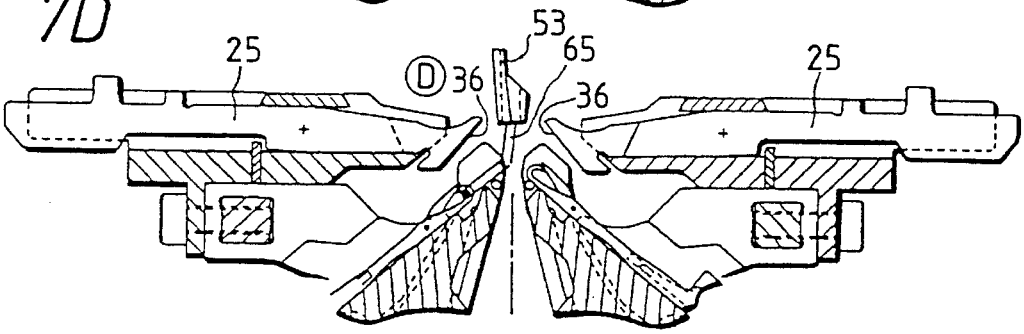

A cam box 45 of a carriage is provided on an upper face of the needle bed 1 by known means so that the needles on the needle bed 1 can be operated by a needle operation cam 64 shown in FIG. 5. The operation means 28 for the yarn holding down members 25 is provided on the cam box 45 by means of an arm 46. The operation means 28 includes a yarn holding down member advancing and retracting cam 48 having a cam groove 47, and a return cam 49. The control butts 37 of the yarn holding down members 25 are accepted in the cam groove 47 of the yarn holding down member advancing and retracting cam 48 defining a pair of cam lobes 48*a* and 48*b* so that the yarn holding down members 25 are moved forward and backwardly in the grooves 35 of the yarn holding down member supporting bed 26. The cam lobes 48*a* and 48*b* are provided, in the example shown in FIG. 5, at locations above the opposite inclined faces of a raising cam 60 of the needle operation cam 64 in the proximity of the knock over edge of the needle bed 1. However, in a simplified apparatus, only one cam lobe may be provided above either one of the inclined faces of the raising cam 60.

Figures 17A, 17B:
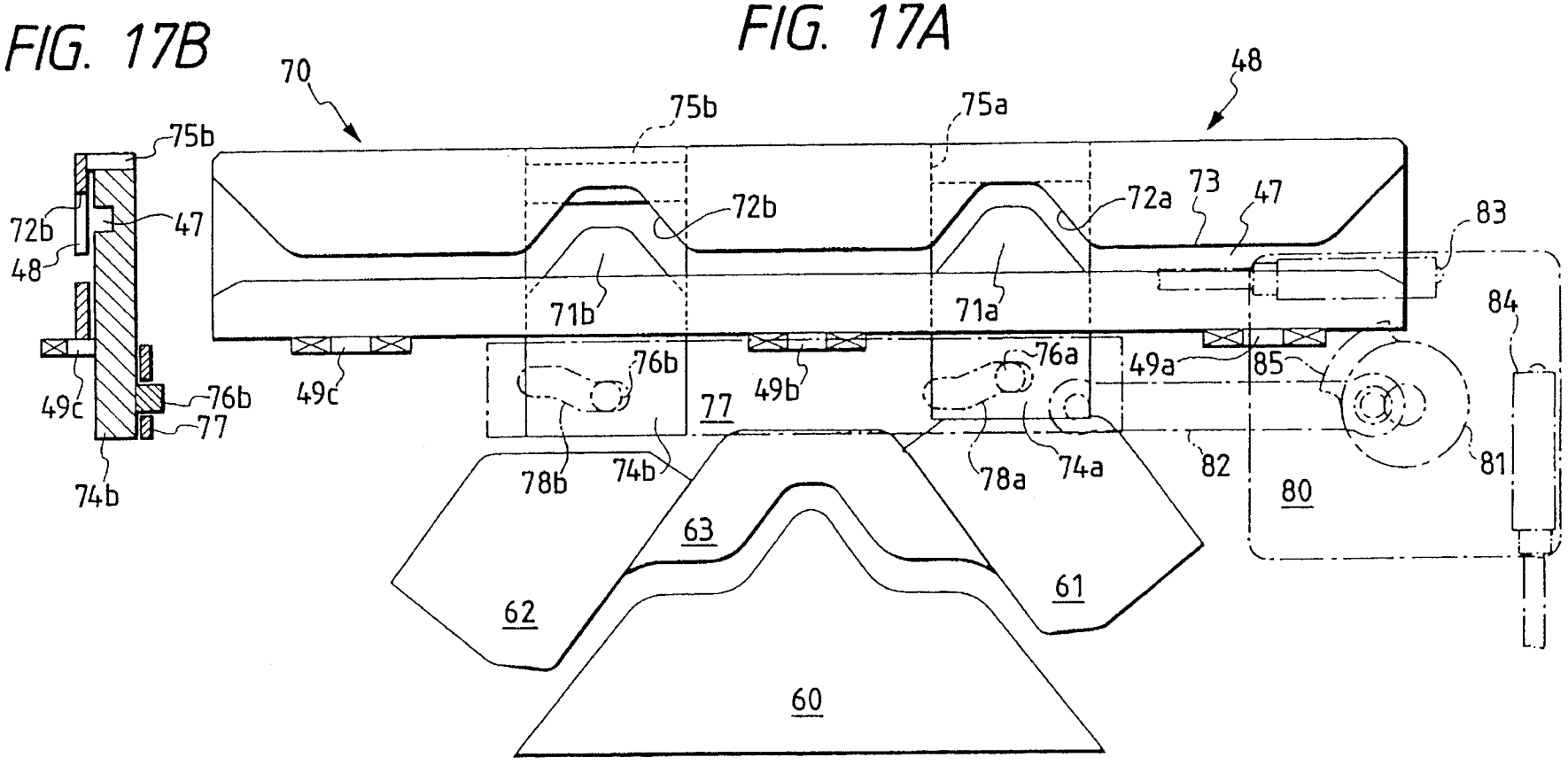
FIG. 17A is a schematic plan view of a yarn holding down member advancing movement control apparatus.
FIG. 17B is a sectional view.

The return cam 49 is contacted with upper faces of the tail portion 42 of the yarn holding down members 25 to pivot the yarn holding down members 25 in the clockwise direction in FIG. 1 around the fulcra 41 to sink the control butts 37 into the grooves 35 to disengage the yarn holding down members 25 from the yarn holding down member advancing and retracting cam 48. The cam lobes 48*a* and 48*b* may be constructed so as to vary the height thereof so that the height of the cam lobes 48*a* and 48*b* is varied depending upon whether a yarn should be caught by the hooks of the needles or be pushed to the rear faces of the needles in order to reduce the possibility that the yarn may suffer from an unnecessary disturbance. An example of a yarn holding down member advancing movement control apparatus 70 of the yarn holding down operation means 28 is shown in FIG. 17. The yarn holding down member advancing movement control apparatus 70 is the device for determining the advancing position of the yarn holding down member 25. The selection of the yarn holding down members 25 is performed by the selection means 27 and only selected yarn holding down members 25 are advanced or retracted by the yarn holding down member advancing movement control apparatus 70. The yarn holding down member advancing and retracting cam 48 having the case groove 47 includes a pair of movable cams 71*a* and 71*b* provided for advancing and retracting movement in a direction perpendicular to the cam groove 47 at locations above left and right portions of the raising cam 60 for advancing the operating faces 36 at the ends of the yarn holding down members 25 toward a yarn, and a pair of recessed portions 72*a* and 72*b* provided at an upper edge 73 of the cam groove 47 such that a center line therebetween is common to that between the movable cams 71*a* and 71*b* but they are arranged in a valley-like configuration while the movable cams 71*a* and 71*b* are arranged in a mountain-like configuration. The movable cams 71*a* and 71*b* and the recessed portions 72*a* and 72*b* define therebetween a pair of paths along which the control butt 37 of a yarn holding down member 25 passes. The movable cams 71*a* and 71*b* are provided integrally with a pair of cam plates 74*a* and 74*b* such that comparatively thick portions of the cam plates 74*a* and 74*b* are formed as the movable cams 71*a* and 71*b*, respectively. The control butt 37 of a yarn holding down member 25 passes along comparatively thin portions of the cam plates 74*a* and 74*b*. The cam plates 74*a* and 74*b* are both fitted for sliding movement by suitable means in a pair of grooves 75*a* and 75*b* provided on the yarn holding down member advancing and retracting cam 48. The grooves 75*a* and 75*b* extend in the direction of advancing and retracting movement of a yarn holding down member 25 and the movable cams 71*a* and 71*b* can move in the direction therein, respectively. A pair of engaging pins 76*a* and 76*b* are provided on the cam plates 74*a* and 74*b* and held in engagement with a pair of guide slots 78*a* and 78*b* in a slide plate 77, respectively. The guide slots 78*a* and 78*b* are curved in symmetrical shapes relative to each other such that, when the slide plate 77 is moved slidably, if the guide slot 78*a* pushes out the engaging pin 76*a*, then the other guide slot 78*b* draws back the engaging pin 76*b*.

The slide plate 77 is connected by way of a connecting rod 82 to a disk 81 supported on a motor shaft of a step motor 80 so that it is moved back and forth by rotation of the step motor 80. Reference numerals 83 and 84 denote each a sensor, which detects, when a projection 85 of the disk 81 comes near to it, the projection 85 to stop rotation of the step motor 80.

An actuator 50 as the selection means 27 is supported on the cam box 45 by means of a support arm 51. When a projecting element 52 of the actuator 50 is projected, it is contacted with a lower edge of the tail portion 42 of a yarn holding down member 25 to pivot the yarn holding down member 25 in the counterclockwise direction around the fulcrum 41 to cause the control butt 37 of the yarn holding down member 25 to project from the corresponding groove 35 so that the control butt 37 is engaged with the yarn holding down member advancing and retracting cam 48 and moved to a position at which it is fitted into the cam groove 47 of the yarn holding down member advancing and retracting cam 48.

Reference numeral 53 denotes a yarn feeder located substantially above the center between the knock over edges 24, and the position (height) of the yarn feeder 53 at which a yarn 65 is discharged is lower than the position of upper ends of the operating faces 36 at the front ends of the yarn holding down members 25.

An actual knitting operation of the apparatus of the present invention will be described below.

FIG. 5 shows an arrangement of the needle operation cam 64, yarn holding down member advancing and retracting cam 48, return cams 49*a*, 49*b* and 49*c*, and actuators 50*a*, 50*b*, 50*c* and 50*d* of the cam box 45.

It is assumed that the needle operation cam 64 having the raising cam 60, a pair of knitting cams 61 and 62 and a guard cam 63 and the cam box 45 having the yarn holding down member advancing and retracting cam 48, the return cams 49*a*, 49*b* and 49*c* and the actuators 50*a*, 50*b*, 50*c* and 50*d* shown in FIG. 5 move in the rightward direction. When any yarn holding down member 25 fitted for sliding movement in the yarn holding down member supporting bed 26 comes to the position of the return cam 49*a* as the cam box 45 moves rightwardly, the tail portion 42 of the yarn holding down member 25 is contacted with the return cam 49, so that the control butts 37 of all of the yarn holding down members 25 are sunk into the grooves 35. In this condition, when the actuator 50*a* comes to the position of a yarn holding down member 25 to be selected, the actuator 50 is rendered operative.

As a result of the operation of the actuator 50*a*, the projecting element 52 of the actuator 50*a* is projected (FIG. 1) to pivot the tail portion 42 of the yarn holding down member 25 in the counterclockwise direction around the fulcrum 41 to introduce the control butt 37 into the cam groove 47 (① in FIGS. 5 and 6). Upon succeeding advancement of the cam box 45, the corresponding needle jack butt 10 passes by a lowermost portion of the knitting cam 61 and the needle remains substantially at its raised position, but the control butt 37 of the yarn holding down member 25 is raised by and along the cam lobe 48*a* of the yarn holding down member advancing and retracting cam 48 to advance the yarn holding down member 25 toward the knock over edge 24. The advancement takes place simultaneously on both of the front bed side and the back bed side (② in FIGS. 5 and 6).

As a result of the advancement of the yarn holding down member 25 to the knock over edge 24, a yarn 65 supplied along the knock over edge 24 is contacted with the operating face 36 of the yarn holding down member 25 and acted upon by a pushing down action from the opposite sides thereof so that it is positioned at the lowermost position of the operating face 36. This position is lower than the rising locus of the needle 8 being raised. Then, the needle jack butt 10 is raised by and along the corresponding inclined face of the raising cam 60 to raise the needle 8. However, since the yarn 65 is positioned below the locus along which the needle 8 is raised, the yarn 65 is positioned on the rear face of the needle and is not caught by the hook of the needle (③ in FIGS. 5 and 6). Upon succeeding movement of the cam box 45, the control butt 37 is lowered by and along the cam lobe 48*a* so that the yarn holding down member 25 is retracted to its most retracted position so that the yarn 65 is positioned on the rear face of the needle 8 (④ in FIGS. 5 and 6).

The thus projected control butt 37 of the yarn holding down member 25 having passed the cam lobe 48*a* is pushed into the groove 35 by the return cam 49*b*.

In order to guide the yarn 65 otherwise into the hook of the needle 8, the yarn 65 is held on an upper edge of the needle 8 by the yarn holding down member 25 before the needle 8 is lowered by the knitting cam 62 after the needle 8 passes the top of the raising cam 60. The yarn holding down member 25 corresponding to an object one of the needles 8 which are being lowered by and along the inclined face of the raising cam 60 in FIG. 5 comes to the position of the actuator 50*b*, the actuator 50*b* is rendered operative so that the yarn holding down member 25 is pushed up by the projecting element 52 of the actuator 50*b* to project the control butt 37 thereof into the cam groove 47, and consequently, the control butt 37 is raised along and by the cam lobe 48*b* as the cam box 45 further moves (A of FIGS. 5 and 7). By this operation, the yarn holding down member 25 advances the operating face 36 thereof toward the yarn 65 at the knock over edge 24 from the opposite Sides to its most advanced position at which the yarn 65 is pressed against the inner side of the hook of the needle 8. In this instance, the needle 8 starts its lowering movement (B of FIGS. 5 and 7). While the operating face 36 remains in the most advanced position, the needle 8 is further lowered (C in FIGS. 5 and 7), whereupon the yarn 65 is caught fully by the hook of the needle 8 until the yarn holding down member 25 is lowered fully and also the needle 8 is lowered (D of FIGS. 5 and 7).

The control butt 37 fitted in the cam groove 47 is pushed into the grooves 35 by the return cam 49*c*. The actuators 50*c* and 50*d* are used when the cam box 45 is moved leftwardly. In particular, when the carriage is moved rightwardly, a yarn holding down member 25 is selected by the actuator 50*a*, and the yarn holding down members 25 is advanced by the cam lobe 48*a* so that a yarn is guided to the rear face of a corresponding needle, whereafter a yarn holding down member 25 selected by the actuator 50*b* and is advanced by the cam lobe 48*b* to guide the yarn into the hook of the needle. However, when the carriage is moved leftwardly, a yarn holding down member 25 is selected by the actuator 50*c*, and the yarn holding down member 25 is advanced by the cam lobe 48*b* so that a yarn is guided to the rear face of a corresponding needle, whereafter a yarn holding down member 25 is selected by the actuator 50*d* and is advanced by the cam lobe 48*a* to guide the yarn into the hook of the needle.

Figure 15:
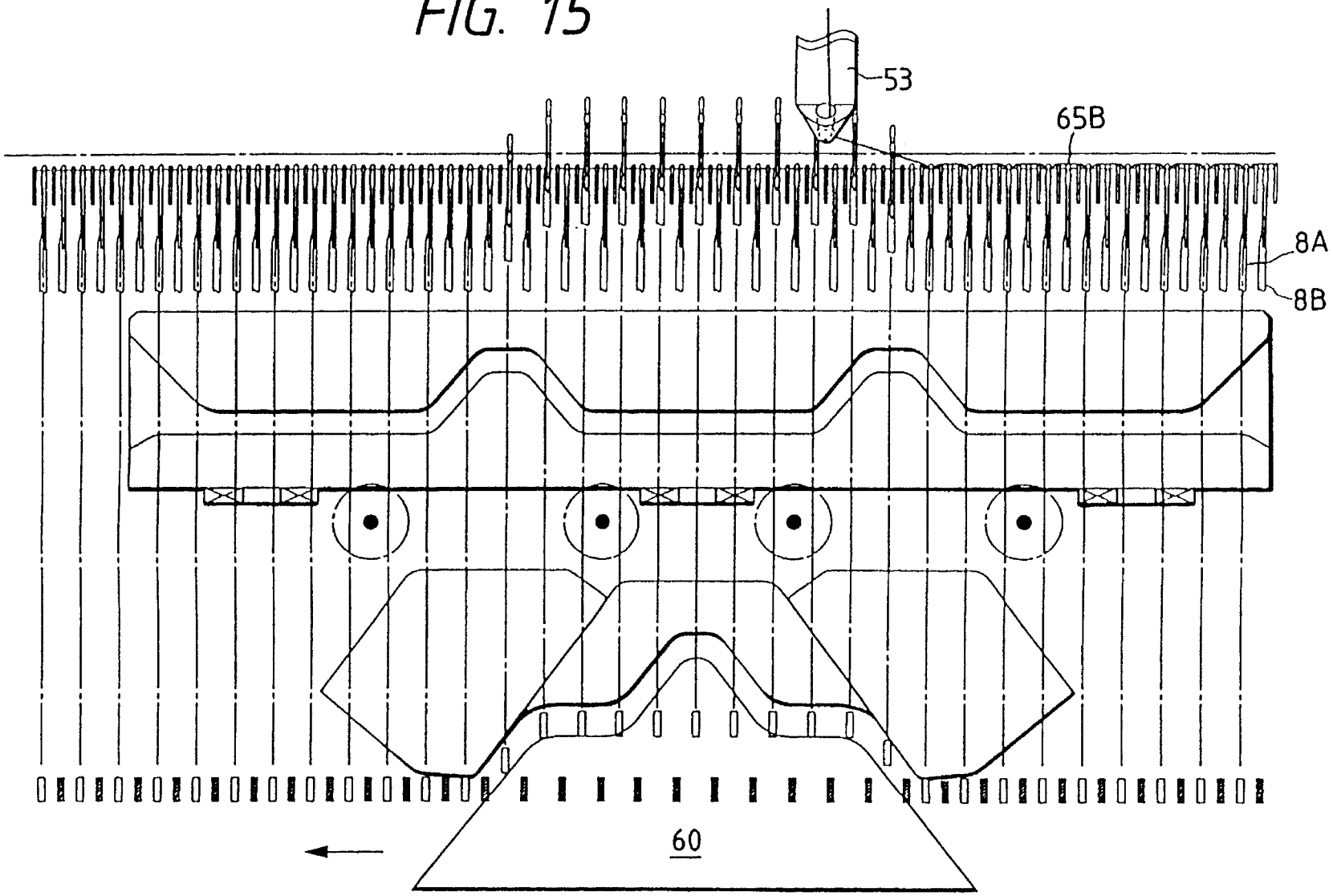
FIG. 15 is a view of a concept illustrating a positional relationship among needles, yarn holding down members and the yarn feeder upon knitting of an inlay fabric and shows a first position.
Figure 16:
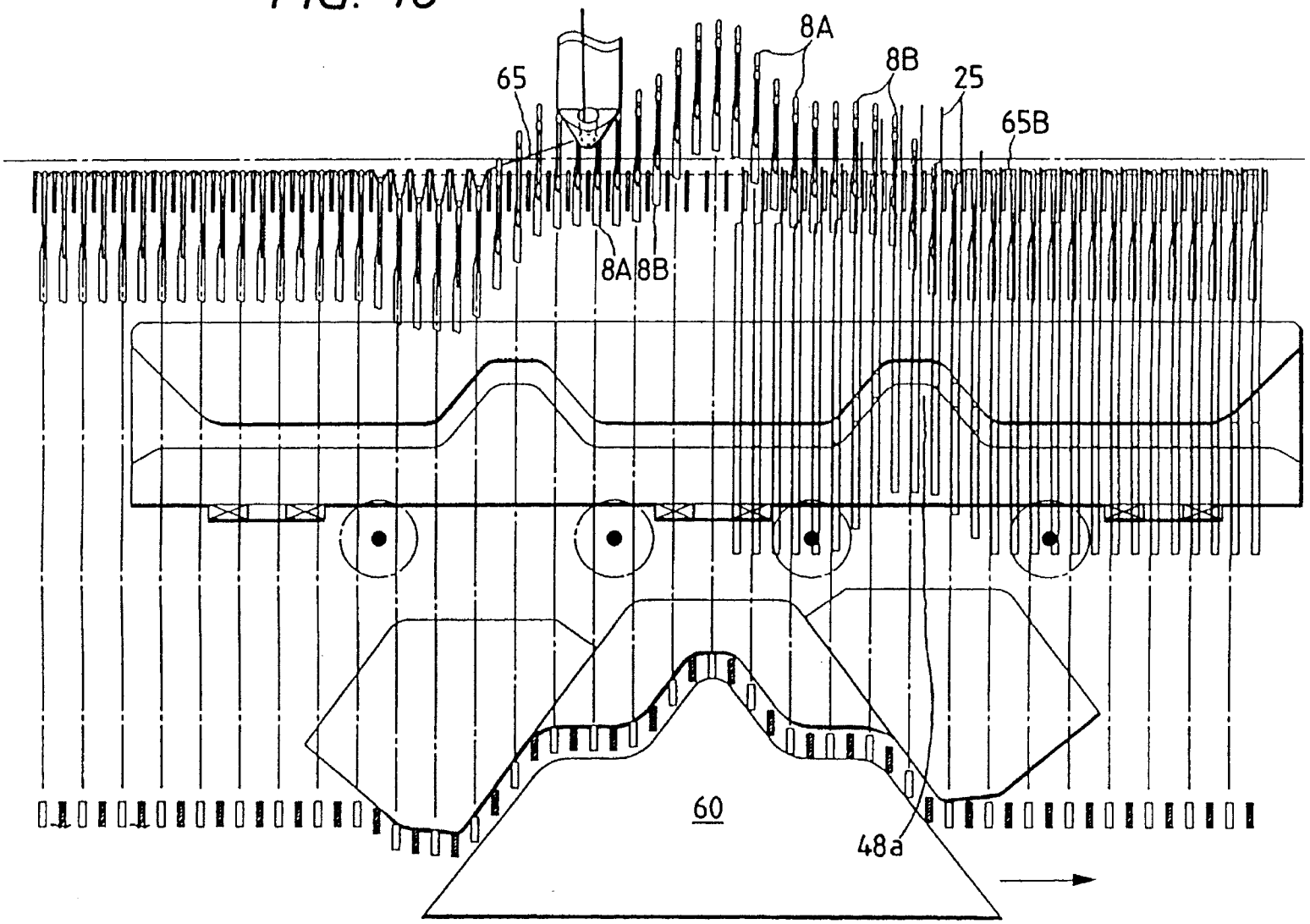
FIG. 16 is a view of a concept illustrating another positional relationship among needles, yarn holding down members and the yarn feeder upon knitting of an inlay fabric and shows a second position.

A procedure of operations of the needles, the yarn holding down members and the yarn feeder upon knitting of an intarsia fabric is illustrated in FIGS. 9 to 13 while another procedure of operations of the needles, the yarn holding down members and the yarn feeder upon knitting of an inlay fabric is illustrated in FIGS. 15 to 16.

Figure 8:
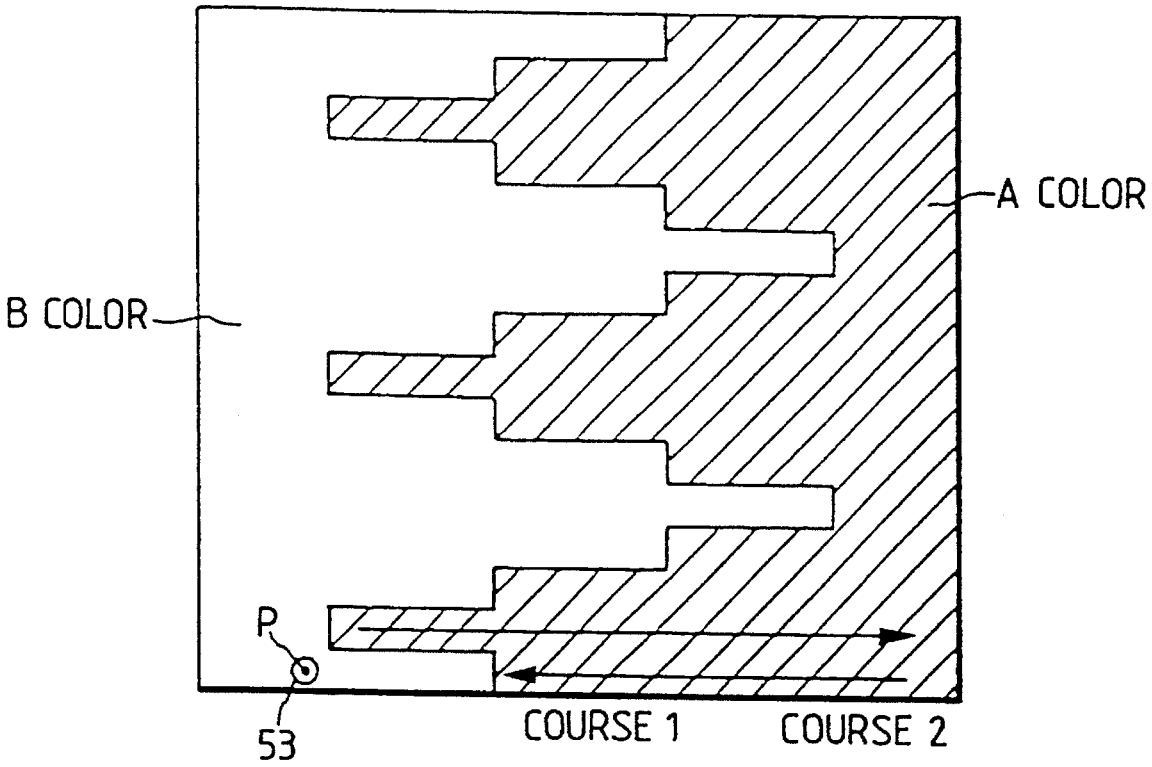
FIG. 8 is a diagram illustrating an arrangement of a pattern of a knit fabric of an intarsia pattern.

Knitting of such a fabric wherein the width of an intarsia pattern which includes a portion of an A color indicated by slanting lines and another portion of another B color which extend long into each other varies suddenly in the direction of a course as shown in FIG. 8 will be described with reference to FIGS. 9 to 13.

Figure 9:
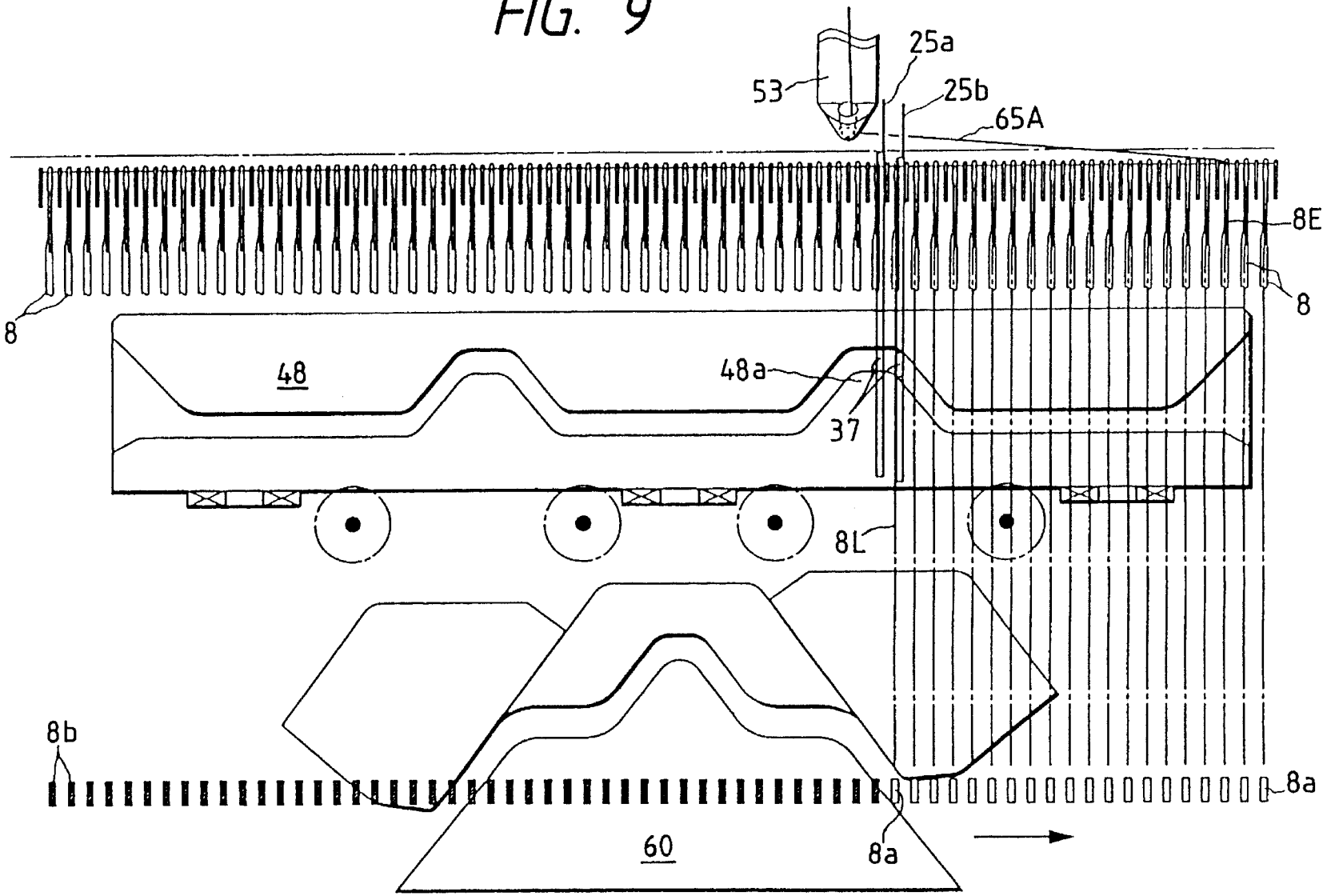
FIG. 9 is a view of a concept illustrating a positional relationship among needles, yarn holding down members and a yarn feeder upon knitting of an intarsia fabric and shows a first position.

It is assumed that, in FIG. 8, the A color portion of the course 1 is first knitted by moving the carriage from the right to the left in FIG. 8 while a yarn is supplied from the yarn feeder 53 accompanying the carriage. After the A color portion of the course 1 is knitted, the carriage moves the yarn feeder 53 to a point P, and then, at the position P, the yarn feeder 53 is released from the carriage to stop on the needle bed while the carriage continues to move to a predetermined reversing position on the knitting machine. A condition before the carriage starts knitting of the A color portion of the course 2 from the left to the right after reversal thereof at the reversing point is illustrated in FIG. 9. It is to be noted that the A color portion is knitted by those needles whose jack butts 8*a* are indicated blank in FIGS. 9 to 13 whereas the B color portion is knitted by those needles 8 whose jack butts 8*b* are indicated by slanting lines.

Upon rightward movement of the carriage, before an inclined face of the raising cam 60 and the jack butt 8*a* of a needle 8L at the left end of the A color portion are contacted with each other and then the needles are successively raised, the control butts 37 of the yarn holding down members 25*a* and 25*b* on the opposite sides of the needle 8L at the left end of the A color portion of the course 2 selected by the selection means 27 are contacted with the cam lobe 48*a* of the yarn holding down member advancing and retracting cam 48 so that the yarn holding down members 25*a* and 25*b* are advanced to the opposite sides of the needle 8L. Thereupon, the operating faces 36 of the yarn holding down members 25*a* and 25*b* hold down a yarn 65A extending between the yarn feeder 53 and the last needle 8E which has knitted the A color portion of the course 1, and guides the yarn 65A to a position below the locus of advancing and retracting movement of the needle 8L at the left end of the A color portion (to the rear face side of the needle 8L).

Figure 10:
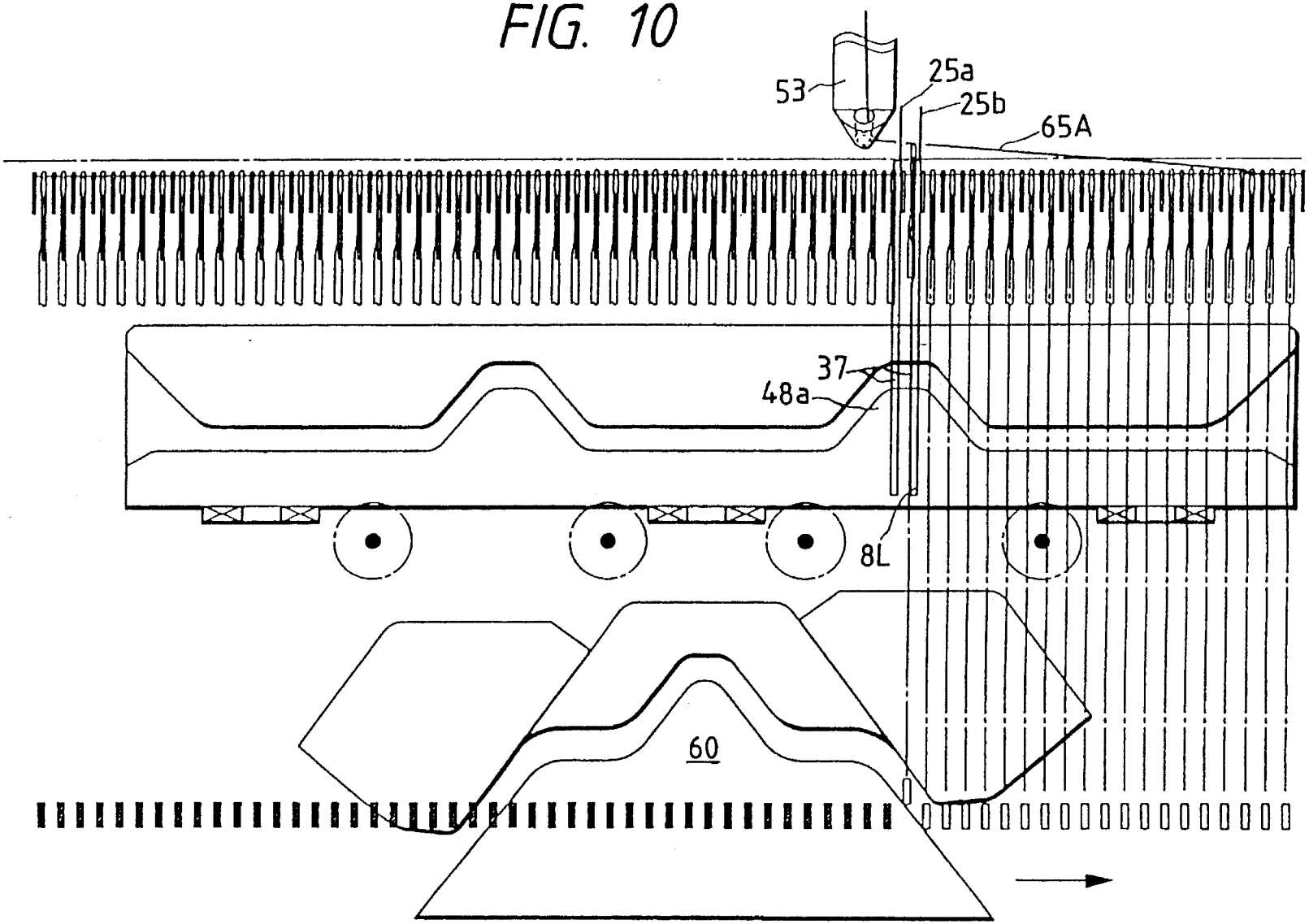
FIG. 10 is a view of a concept illustrating another positional relationship among needles, yarn holding down members and the yarn feeder upon knitting of an intarsia fabric and shows a second position.
Figure 11:
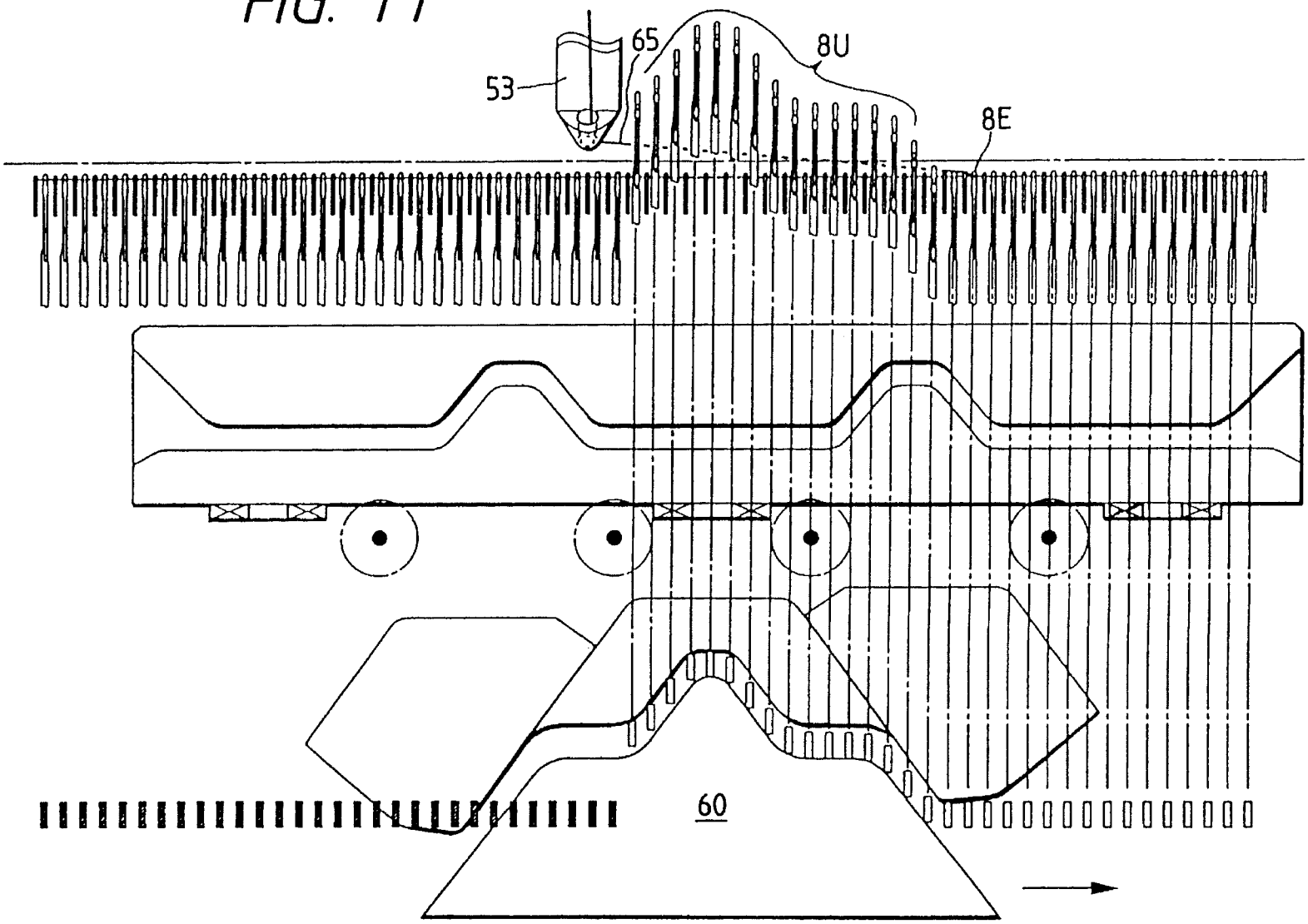
FIG. 11 is a view of a concept illustrating a further positional relationship among needles, yarn holding down members and the yarn feeder upon knitting of an intarsia fabric and shows a third position.

When the carriage is further moved rightwardly, the needle 8L at the left end of the A color portion is further advanced by the raising cam 60 so that the top portion of the hook thereof is going to reach the front of the yarn 65A (FIG. 10). In this instance, the control butts 37 of the yarn holding down members 25*a* and 25*b* on the left and right of the needle 8L are positioned at the top portion of the cam lobe 48*a*, and accordingly, the operating faces 36 of the yarn holding down members 25*a* and 25*b* push the yarn 65A most. Even in FIGS. 9 and 10, the yarn feeder 53 is not yet engaged with the carriage but remains in a stopping condition.

When the carriage is further moved rightwardly (shown in FIG. 11), the needles for the A color portion of the course 2 are advanced to a knitting position by the raising cam 60. In this condition, the yarn 65A extending from the needle 8E at the left end of the A color portion of the course 1 to the yarn feeder 53 passes on the rear (rear face) side of all of the needles 8U which are in the advanced position.

Figure 12:
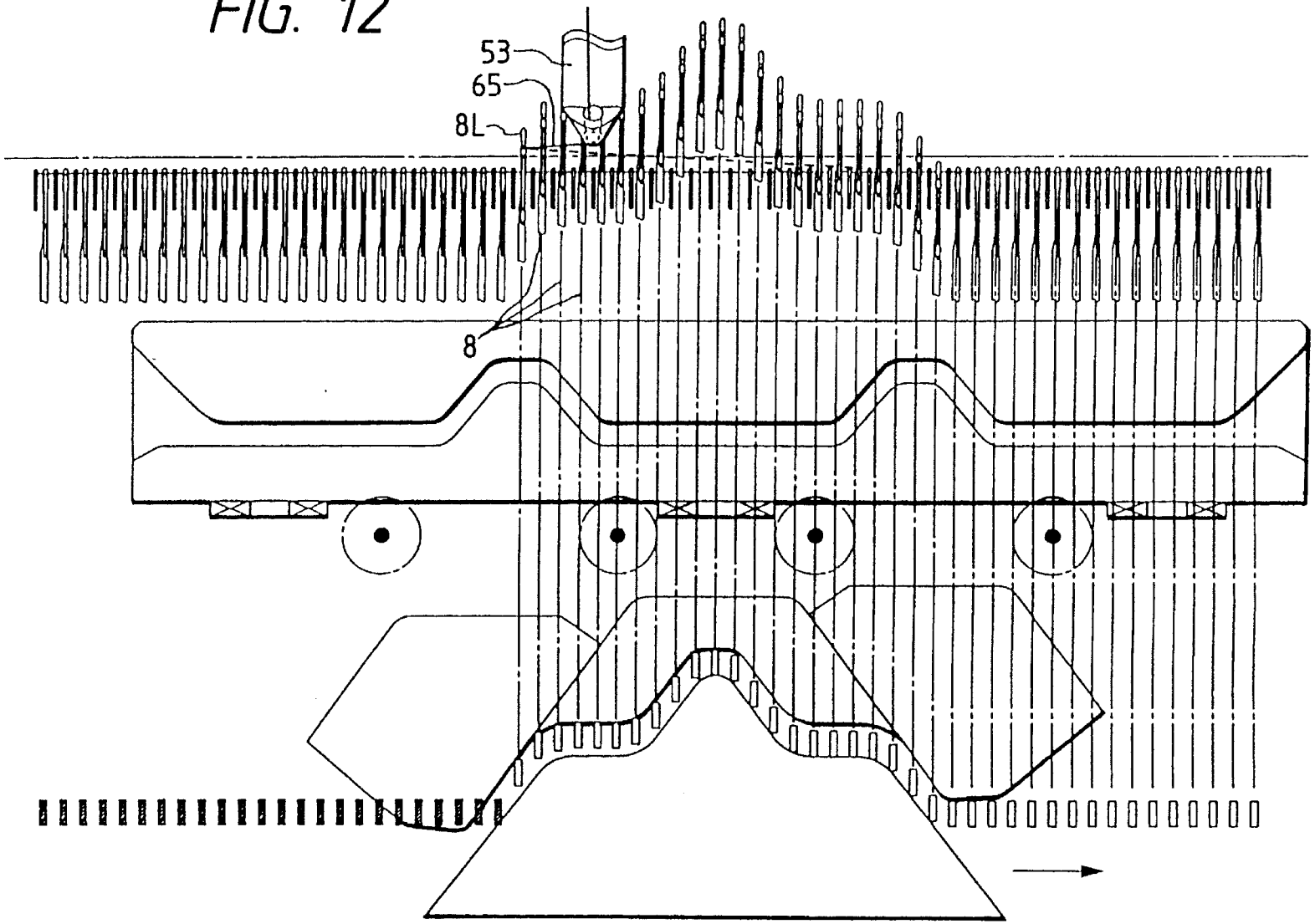
FIG. 12 is a view of a concept illustrating a still further positional relationship among needles, yarn holding down members and the yarn feeder upon knitting of an intarsia fabric and shows a fourth position.
Figure 13:
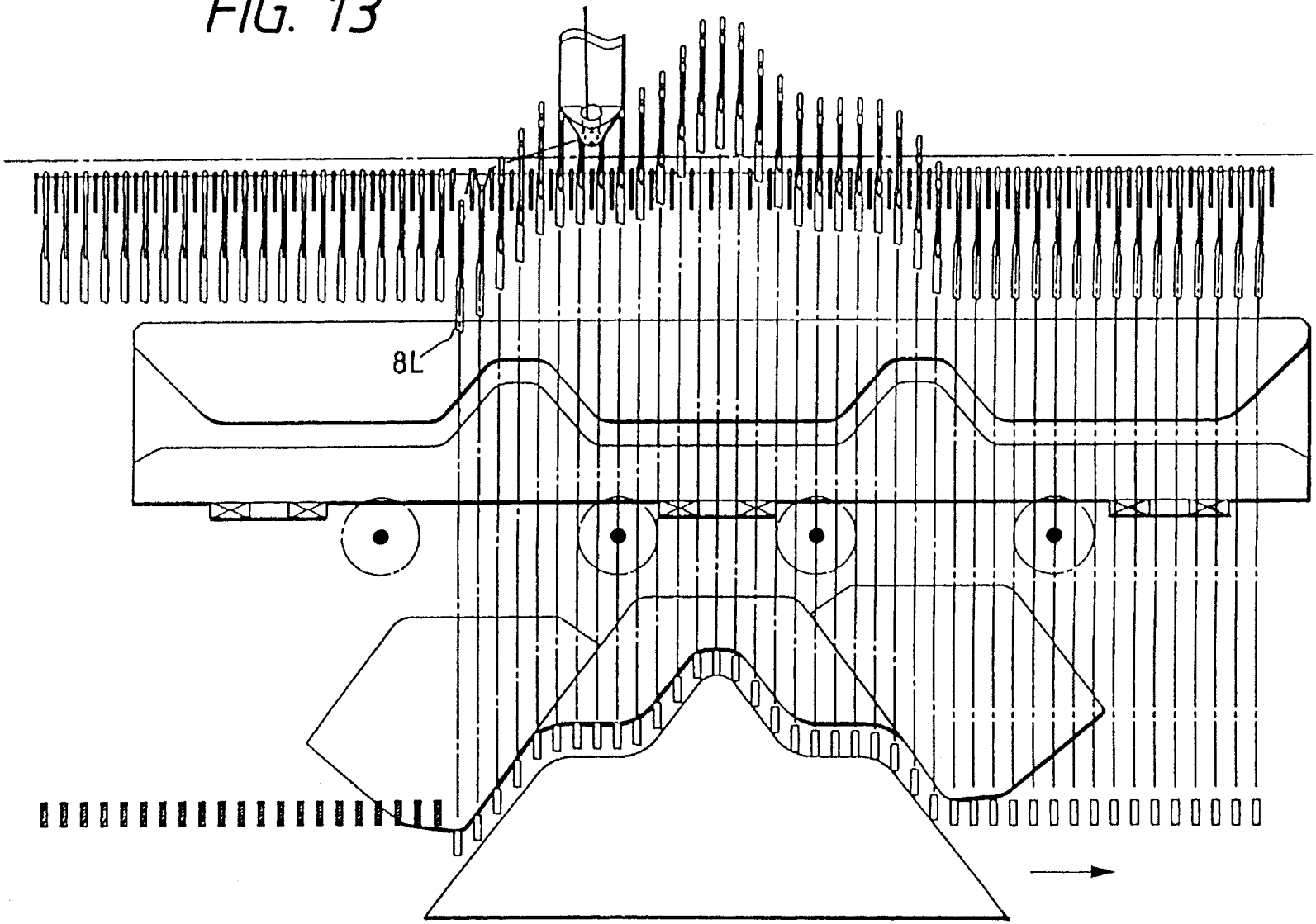
FIG. 13 is a view of a concept illustrating a yet further positional relationship among needles, yarn holding down members and the yarn feeder upon knitting of an intarsia fabric and shows a fifth position.

Then, when the carriage is further moved rightwardly (shown in FIG. 12), the yarn feeder 53 is at last engaged with the carriage so that it is thereafter carried by the carriage to start its rightward movement. As the rightward movement of the yarn feeder 53 starts, the yarn 65A positioned on the rear face of the needle 8L positioned at the left end of the course 2 is guided to the front face of the needle 8L at the left end of the A color portion and is supplied to the hooks of the needles 8, which are to knit the A color portion of the course 2, subsequent to the reversal point provided by the needle 8L (FIG. 12). Consequently, as the carriage further moves, knitting of the A color portion of the course 2 is performed. FIG. 13 illustrates a condition wherein the two needles including the needle 8L at the left end of the A color portion of the course 2 and a right adjacent needle to the needle 8L form loops, and in the example shown, a knit fabric of an intarsia pattern having the course 2 which projects over the length corresponding to 17 needles farther than the course 1 can be knitted by the rightward stoke of the carriage.

Figure 14:
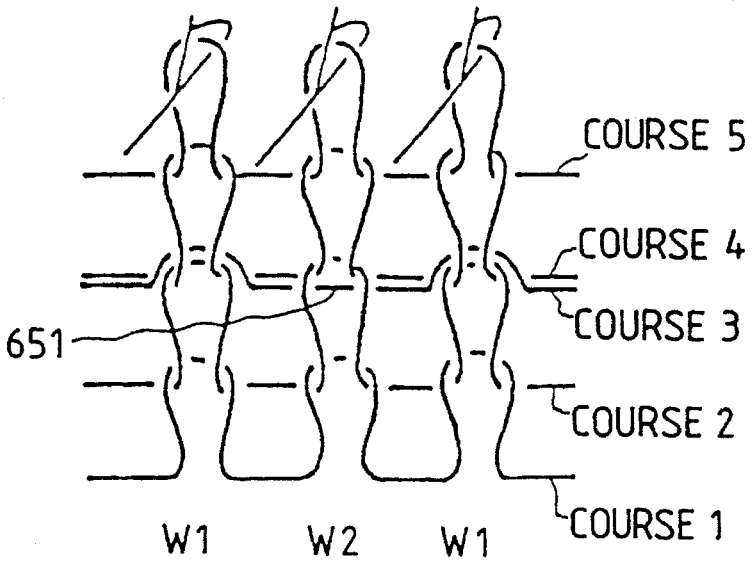
FIG. 14 is a diagram of a texture of an inlay knit fabric.

Subsequently, a knitting procedure for a knit fabric of an inlay texture shown in FIG. 14 will be described.

The knit fabric is an example which has a texture wherein a first wale W1 which includes repetitions of knit, knit, tuck, knit and knit and a second wale W2 which includes repetitions of knit, knit, miss, knit and knit are disposed alternately with each other and wherein a course which includes such misses is formed from an inlay yarn.

Although the course 1 and the course 2 are knitted in a plain stitch using all of the needles, in order to knit the course 3, those needles 8A to knit the first wales W1 are selected to the tuck position whereas those needles 8B to knit the second wales W2 are selected to the miss position and the carriage is moved leftwardly, whereupon the yarn feeder 53 is carried by the carriage so that a yarn supplied therefrom is tucked by every other needle, that is, by all of the needles 8A. A crossing yarn 65B appears in each of the wales of the needles 8B at each miss position. At the step described above, the yarn holding down members 25 are kept inoperative. Then, upon knitting of the course 4 by rightward movement after reversal of the carriage shown in FIG. 16, the yarn 65 is supplied from the yarn feeder 53 to knit plain stitches using all of the needles 8A and 8B. In this instance, a yarn holding down member 25 is advanced by the cam lobe 48*a* of the yarn holding down member advancing and retracting cam 48 on the leading side (right side) toward the yarn 65B extending between the adjacent needles 8A, 8A which have tuck loops thereon to push down the yarn 65B. In the condition wherein the yarn 65B is pushed down, the needles 8A and 8B are advanced by the raising cam 60 so that the yarn 65B pass on the rear face side of the needles 8A and 8B. While, in the example shown in FIG. 16, all of the yarn holding down members 25 are selected operative, only those yarn holding down members which are positioned on the upper side in the moving direction of the carriage, that is, on the right sides of those needles which miss the yarn shown in FIG. 15.

In both of the examples of the intarsia fabric and the inlay fabric, if both of the yarn holding down members provided at the upper locations of both of the opposed pair of needle beds are rendered operative, then a yarn can be guided to a desired position with a higher degree of accuracy.

Figure 18:
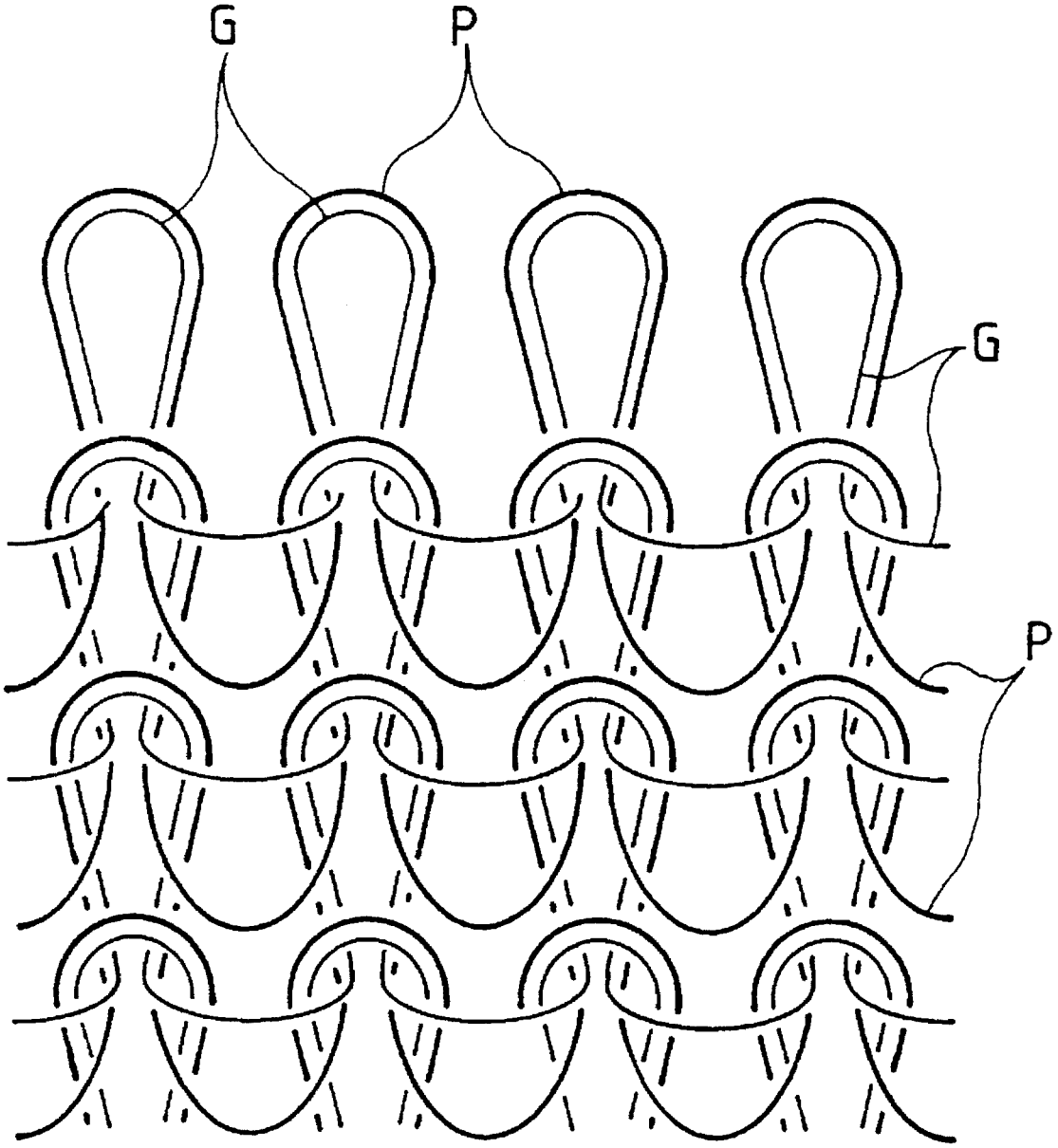
FIG. 18 is a diagram of a texture of a pile knit fabric.
Figure 19A:
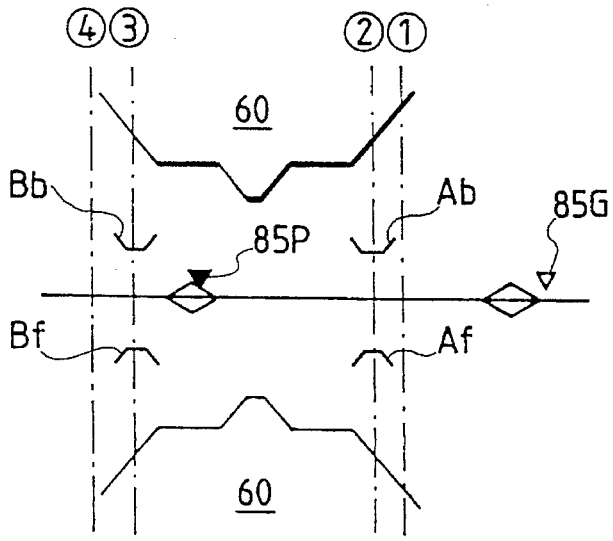
FIG. 19A is an arrangement diagram of cams of carriages and yarn feeders.
Figure 19B:
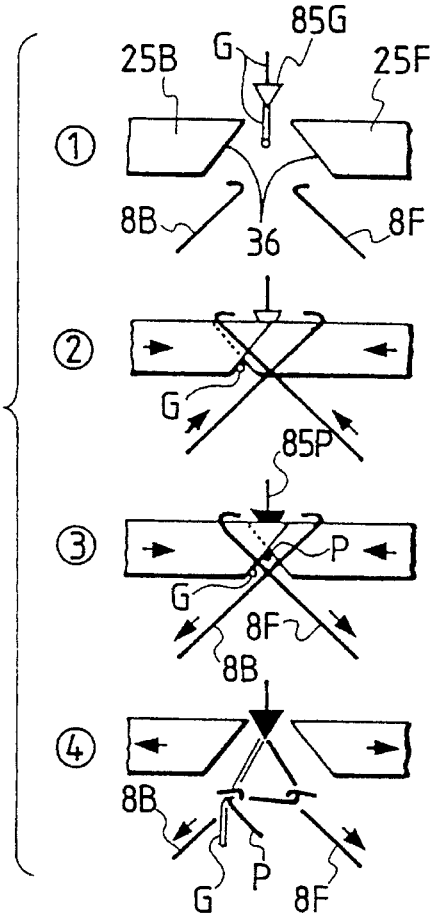
FIG. 19B is a step diagram showing advancing and retracting movements of yarn holding down members and needles.
Figure 19C:
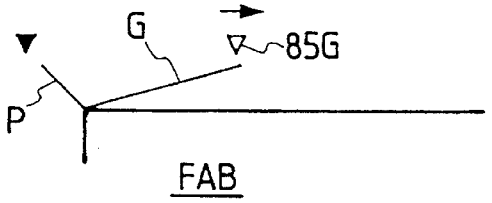
FIGS. 19C and 19D are schematic views illustrating positional relationships of a yarn feeder to a knit fabric.
Figure 19D:
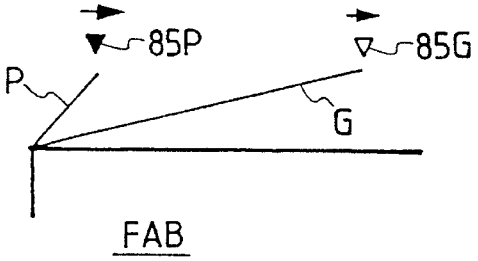

Subsequently, a knitting procedure for a knit fabric of a pile texture shown in FIG. 18 will be described. In knitting of a pile texture, yarns are supplied from two yarn feeders including a yarn feeder for a pile yarn P for forming pile stitches and another yarn feeder for a ground yarn G for forming a ground structure. The two yarn feeders are used in two different manners including a manner wherein they are both positioned above the center between the knock over edges and another manner wherein only the yarn feeder for a pile yarn is positioned above the center between the knock over edges whereas a ground yarn is positioned behind the front bed needles in advance and is supplied only to the back bed needle (or vice versa).

In the following, knitting in the first manner described above will be described. In the present manner, the apparatus described hereinabove with reference to FIG. L7 is used to operate the yarn holding down members 25 on the front bed side while the apparatus shown in FIG. 1 which can operate the yarn holding down members 25 independently of one another at the individual operation positions is used to operate the yarn holding down members 25 on the back bed side. When the carriage moves rightwardly, the yarn feeder 85G for the ground yarn G leads the yarn feeder 85P for the pile yarn P as shown in FIG. 19. The needles 8F and 8B are not at raised positions on both of the front bed and the back bead (① in A and B of FIG. 19). In this instance, since the yarn feeder 85G for the ground yarn G beings to move into the width of the knit fabric FAB, the ground yarn G enters a condition wherein it extends obliquely from the last stitch formation location of the last course to the yarn feeder 85G for the ground yarn as seen in C of FIG. 19. When the carriage moves rightwardly, both of the needles 8F and 8B are raised by an action of the raising cam 60, and simultaneously, the yarn holding down members 25F and 25B are advanced. On the front side, maximum advancement is performed by the movable cam 71*a* of the yarn holding down member advancing movement control apparatus 70 shown in FIG. 17, but on the back side, the yarn holding down member sliding means 28 shown in FIG. 1 is used. The amounts of the advancements of them are different from each other, and the advancement amount of the yarn holding down members 25F on the front side is greater so that the yarn holding down members 25F assume a position to push in the ground yarn G to the positions on the rear faces of the needles 8F. Meanwhile, the yarn holding down members 25B on the back bed side are advanced to another position to guide the ground yarn G to the hooks of the needles 8B. Consequently, even if the needles 8F are raised, the ground yarn G is positioned on the rear faces of the needles 8F while the needles 8B have the ground yarn G positioned in the hooks thereof (② in A and B of FIG. 19).

The advancement of the yarn holding down members 25F on the front bed side is caused by operation of the movable cam 71*a* shown in FIG. 17. FIG. 17 shows the yarn holding down member advancing movement control apparatus 70 on the front bed side, and when the carriage is to be moved rightwardly, the step motor 80 rotates in the clockwise direction, and the projection 85 of the disk 81 remains stopped at the position of the sensor 83. By the rotation of the step motor 80, the slide plate 77 is pushed to move to the left end by way of the link 82, and the slide plate 74*a* integral with the engaging pin 76*a* held in engagement with the guide slot 78*a* of the slide plate 77 is pushed out to its most raised position in the groove 75*a*. Also the movable cam 71*a* integral with the cam groove 74*a* is raised to the utmost. To the contrary, the other cam plate 74*b* integral with the other engaging pin 76*b* held in engagement with the other guide slot 78*b* of the slide plate 77 is drawn down to its most lowered position in the groove 75*b*, and the movable cam 71*b* integral with the cam groove 74*b* is lowered to the utmost.

Accordingly, the yarn holding down members 25F whose control butts 37 are fitted in the cam groove 47 of the yarn holding down member advancing and retracting cam 48 are advanced to the utmost whereas the advancement amount of the yarn holding down members 25B is so small that the ground yarn G is held between the operating faces 36 at the ends of the yarn holding down members 25F and 25B and besides is supported on the back bed side of the knock over edge area. After the needles 8F and 8B on the front and back beds are raised to the utmost, the pile yarn P is supplied to the needles 8F and 8B at the positions where the needles 8F and 8B are retracted to the shoulder portions (③ in A and B of FIG. 19 and D of FIG. 19). Finally, the needles 8F and 8B are lowered to their loop formation positions by an action of the knitting cam 62 (shown in FIG. 17), whereupon the front side needles 8F draw in only the pile yarn P while the back side needles 8B draw in both of the ground yarn G and the pile yarn P to form loops (④ in A and B of FIG. 19).

In this manner, after the needles 8F and 8B on the front and back beds are operated to form pile loops and a ground texture is knitted with the back side needles 8B by the leading cam lock, the loops are cleared from the needles of the front bed, with which the pile loops have been knitted by the leading cam lock, by the trailing cam lock to complete pile stitches. In order to reverse and reversely move the carriage subsequently, the step motor 80 is rotated reversely until the projection 85 is registered with the sensor 4, and after the step motor 80 is stopped, the slide plate 77 is pulled to lower or raise the movable cam 71*a* or 71*b*.

Upon knitting of a pile fabric described above, the yarn feeder for the ground yarn leads and starts its movement, and this may be achieved by various means including a means wherein an apparatus for carrying a ground yarn is provided on a carriage, another means wherein, where a carriage having a plurality of cam locks is used, a ground yarn is carried by a leading lock, and a further means wherein the yarn feeder is not carried by a carrying pin of a carriage but is constructed so as to move itself.

While the examples wherein a yarn is guided by a yarn holding down member to perform knitting of an intarsia fabric, an inlay fabric or a pile fabric have been described above, it is also possible to perform knitting of a spiral fabric. In particular, in knitting of a spiral fabric, knitting is performed only with the needles on one of the two beds, and the position of the yarn feeder for a pile yarn is set such that a set ground yarn is supplied to the hooks of all of the needles while a spiral yarn is guided, for each needle, into the hook or to the rear face of the needle to perform knitting.

The present invention achieves the following effects.

Since the yarn pushing down operating face at an end of the yarn holding down member is advanced between a sinker and a needle toward a yarn which extends from the yarn feeder to the needle or a yarn knitted already and extending between the needle and another needle to guide the yarn into a hook or a rear face of the needle, the yarn can be caught by the hook of the needle with certainty or can be guided to the rear face of the needle at which it cannot be caught by the hook of the needle.

Since the yarn holding down member is contacted, during knitting of a knit fabric, with the yarn extending from the yarn feeder to the needle rearwardly in an advancing direction of the yarn feeder and pushes down the yarn, a yarn supplied newly to the needle can be guided into the hook of the needle with certainty. Consequently, irrespective of the distance between needles, a yarn can be guided into the hooks of the needles with certainty even in floating knitting wherein the distance between the yarn feeder and the position of the needle is long.

Since the yarn holding down member is contacted, during knitting of a knit fabric, with the yarn extending from the yarn feeder to the needle or the yarn knitted already and extending between the needle and another needle forwardly in an advancing direction of the yarn feeder before the needle is raised until a head portion thereof advances farther than the yarn, and then guides, when the needle is raised farther than the yarn, the yarn to a rear face of the needle, an inlay stitch or such a new stitch that a yarn extending from the yarn feeder is wound around a predetermined needle below the yarn can be achieved.

Since each of the yarn holding down members is positioned so that, when the yarn holding down member is advanced, an end thereof goes farther than a center line between knock over edges, even if the position of the yarn supplied is unstable, the yarn can be positioned to a predetermined position with certainty.

Since the yarn operating face at the end of each of the yarn holding down members is formed such that an upper portion thereof extends farther than a lower portion thereof toward a center line between knock over edges so as to push down a yarn, the yarn holding down member can act upon the yarn immediately after the yarn feeder passes it, and besides, since the yarn holding down member is controlled for back and forth movement, the operation completion time can be reduced and the carriage can be reduced in size as much.

Since each of the yarn holding down members is positioned such that an upper end edge of the yarn operating face at the end thereof is at a position higher than a yarn passing area, whichever position the yarn is positioned, the yarn can be caught, which eliminates the restriction in number of needles for floating.

Where the yarn holding down members are provided for both of a pair of needle beds disposed with heads thereof opposed to each other, since the yarn is pushed down with certainty by the operating faces of the yarn holding down members on the front and back needle beds, the yarn can be guided without being influenced by the tension of the yarn or the knitting speed.

Since the yarn holding down members are provided by a number equal to or smaller than the number of needles, where the yarn holding down members are provided corresponding to the individual needles, a needle at any position can be acted upon by a corresponding yarn holding down member. In contrast, where it is determined in advance in accordance with a pattern to be knitted for which needle a yarn holding down member is required, the yarn holding down members should be prepared at the locations of the needles, and the number of yarn holding down members can be reduced.

Since the operation means includes a control butt provided on each of the yarn holding down members and a yarn holding down member advancing and retracting cam provided on a cam box provided for back and forth movement on a needle bed and having a cam groove thereon, and the control butts of the yarn holding down members are engaged with the cam groove, the advancing amount of the yarn holding down members can be varied suitably by changing the shape of the cam groove. Further, the structure can be simplified.

Since the operation means includes selection means, it is possible to select an arbitrary one or ones of the yarn holding down members suitably, and even where a pattern to be knitted does not have regularity, only a required one or ones of the yarn holding down members can be selected and rendered operative. Further, since the selection means is provided, racking of needles can be performed after selected yarn holding down members are retracted, and consequently, knitting which involves intermediate reversal of the carriage wherein the stroke of back and forth movement of the carriage is varied in accordance with the knitting width can be performed.

What is claimed is:

1. A method for guiding a yarn supplied from a yarn feeder to a hook of a needle in a flat knitting machine, comprising:

providing a needle operating means for operating a needle, advancing the needle supported on a needle bed toward a knock over edge area of the needle bed by the needle operating means, supplying a yarn to the knock over edge area by moving the yarn feeder over the needle bed and feeding a yarn from the yarn feeder which is arranged over the needle bed and is movable along the longitudinal direction of the needle bed, placing the yarn fed from the yarn feeder so that the yarn extends over an upper edge of the advanced needle, advancing a yarn holding member which is arranged over the needle bed for advancement toward or retraction from the knock over edge area, by a yarn holding member operating means for operating the yarn holding member, bringing an operating face of the yarn holding member into contact with the yarn extending over the needle and pushing down the yarn, retracting the advanced needle by the needle operating means and holding the yarn pushed down toward the needle by a hook of the needle, retracting the yarn holding member from the knock over edge area.

2. A method for guiding a yarn supplied from a yarn feeder to a rear face of a needle in a flat knitting machine, comprising:

providing a yarn feeder over a needle bed, the yarn feeder being reciprocateable along a longitudinal direction of the needle bed, moving the yarn feeder to feed a knitting yarn, arranging a yarn holding member on a needle bed to be advanced to or retracted from a knock over edge area by an yarn holding member operating means for operating the yarn holding member mounted on a cam box, advancing the yarn holding member to a knock over edge area, contacting an operating face of the yarn holding member with the yarn to push down the yarn toward the advancing track of the needle, advancing a needle to the knock over edge area by the needle operating means, passing the needle over the yarn which is pushed down by the operating face of the yarn holding member, locating the knitting yarn at a rear face of the needle, and retracting the yarn holding member from the knock over edge area by the yarn holding member operating means.

3. A yarn guiding apparatus for a flat knitting machine, the flat knitting machine comprising a yarn feeder and a pair of opposed needle beds defining a knock over edge area and a center line therebetween, at least one of the needle beds having mounted thereon a plurality of needles and a plurality of sinkers arranged between the needles, the yarn guiding apparatus comprising:

at least one yarn holding member arranged between at least one of the plurality of needles and at least one of the plurality of sinkers, the yarn holding member being advanceable toward and retractable from the knock over edge area and having an operating face for pushing down a yarn fed from the yarn feeder to the knock over edge area, the operating face being configured for contacting the yarn and for pushing the yarn down toward at least one of the needles when the yarn holding member is advanced toward the knock over edge area, yarn holding member operating means for operating the yarn holding member, the yarn holding member operating means comprising a butt formed on the yarn holding member, and a cam provided in a cam box for controlling at least one of advancement of the yarn holding member toward and retraction of the yarn holding member from the knock over edge area, the cam being operable for engaging the butt of the yarn holding member and for advancing the yarn holding member to a position wherein at least a portion of the yarn holding member extends beyond the center line defined by the opposing needle beds.

4. The apparatus of claim 3, wherein at least one of the needles comprises a hook and wherein the operating face is configured for pushing down yarn supplied to the knock over edge area to a position in which the yarn is engageable by the hook.

5. The apparatus of claim 3, wherein at least one of the needles defines a rear face and wherein the operating face is configured for pushing down yarn supplied to the knock over edge area to a position in which the yarn is guided to the rear face of the needle.

6. The apparatus of claim 3, wherein each of the opposed needle beds defines a head and an upper position, wherein the heads of the needle beds are arranged in an opposed relationship, and wherein the yarn holding member is disposed at the upper position of at least one of the needle beds.

7. The apparatus of claim 3, wherein the plurality of needles comprises a first plurality, and further comprising a second plurality of yarn holding members, wherein the second plurality is not greater than the first plurality.

8. The apparatus of claim 3, wherein the yarn holding member operating means comprises:

an advancing and retracting cam for the yarn holding member, the advancing and retracting cam having a cam lobe, the cam lobe defining a height, and means for adjusting the height of the cam lobe to thereby control at least one of advancing and retracting movement of the yarn holding member.

9. The apparatus of claim 3, comprising a plurality of yarn holding members and wherein the yarn holding member operating means includes selection means for arbitrarily selecting at least one of the plurality of yarn holding members.

10. The apparatus of claim 9, wherein the selection means comprises an actuator having a projecting element for contacting the yarn holding member.

11. The apparatus of claim 3, wherein at least one of the needles defines a butt for controlling at least one of advancement and retraction of the needle, and further comprising a raising cam for operating needles, the raising cam having a plurality of inclined faces for contacting the butt of the needle for controlling at least one of advancement and retraction of the needle, and a cam for operating the yarn holding member, the cam being arranged at a position relative to at least one of the inclined faces of the raising cam.

* * * * *